US006769470B2

(12) United States Patent
Tamai et al.

(10) Patent No.: US 6,769,470 B2
(45) **Date of Patent: *Aug. 3, 2004**

(54) MARK TRANSFER TOOL AND MARK TRANSFER TAPE

(75) Inventors: Shigeru Tamai, Ikeda (JP); Masatoshi Shintani, Sanda (JP); Kouhei Koyama, Kyoto (JP)

(73) Assignee: Seed Company Limited, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/099,945

(22) Filed: Mar. 19, 2002

(65) Prior Publication Data

US 2002/0170684 A1 Nov. 21, 2002

(30) Foreign Application Priority Data

May 21, 2001 (JP) ..... 2001-150432

(51) Int. Cl.[7] ..... B32B 31/00

(52) U.S. Cl. ..... 156/577; 156/579; 118/76; 242/160.4; 242/171; 242/588.6; 206/411; 428/42.3

(58) Field of Search ..... 150/523, 527, 150/538, 540, 574, 577, 579; 118/76, 200, 257; 225/46; 242/160.2, 160.4, 170, 171, 588, 588.2, 588.3, 588.6; 428/42.9

(56) References Cited

U.S. PATENT DOCUMENTS 4,880,490 A * 11/1989 MacIntyre ..... 156/541
5,267,898 A * 12/1993 Doll et al. ..... 462/6
6,547,914 B2 * 4/2003 Schnitzer et al. ..... 156/250
6,575,220 B2 * 6/2003 Tamai et al. ..... 156/577

* cited by examiner

*Primary Examiner*—Mark A. Osele
(74) *Attorney, Agent, or Firm*—Rader, Fishman & Grauer PLLC

(57) ABSTRACT

A mark transfer tool making use of a coat film transfer technology about various marks composed of characters, codes, patterns or their combination. A mark transfer tape is composed of pressure-sensitive adhesive transfer marks disposed and held on the surface of a base tape continuously and peelably at specific intervals, and each mark is composed of a mark and an overwriting blank space. A bodily sensing recess for showing the division position of transfer marks is disposed between the transfer marks, and a positioning bump to be engaged with the bodily sensing recess is provided in the transfer head, and a hooking phenomenon of running motion of mark transfer tape by engagement of the two is recognized as the standard for transfer, so that the transfer mark of the mark transfer tape can be accurately transferred on a correction area.

40 Claims, 26 Drawing Sheets

MARK TRANSFER TOOL AND MARK TRANSFER TAPE

BACKGROUND OF THE INVENTION

1. Field of the Invention

The present invention relates to a mark transfer tool and a mark transfer tape, and more particularly to a mark transfer technology for transferring a transfer mark in a thin film composed of characters, codes, patterns or their combination arranged and formed on a mark transfer tape, to a sheet of paper or the like.

2. Description of the Related Art

Generally, various marks composed of characters, codes, patterns or their combination are prepared as stamps and impressed on a sheet of paper or other object surface through ink, or prepared as mark seals and adhered to a sheet of paper or the like.

In the background of the recent technical innovation and diversification of users' preferences, widening of product variety is needed in various technical fields, and such trend is not exceptional in the stationery field handling various marks.

BRIEF SUMMARY OF THE INVENTION

It is hence a primary object of the invention to present a novel mark transfer tool and mark transfer tape solving the problems of the prior art.

It is other object of the invention to present a novel mark transfer technology completely different from the conventional mark using technology, about various marks composed of characters, codes, patterns or their combination, by making use of coat film transfer technology.

It is another object of the invention to present a mark transfer tool effectively applicable to diversified preferences of general users, by employing a method of transferring a-transfer mark on a mark transfer tape on a sheet of paper or the like.

It is a further object of the invention to present a mark transfer tool using the transfer mark composed of various marks and blank spaces for overwriting, in which various characters can be written over by a writing tool in the blank spaces for overwriting after transfer of transfer marks.

The mark transfer tool of the invention is a tool for transferring a transfer mark on a mark transfer tape on a sheet of paper or the like, comprising a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the correction area, being disposed at the leading end of the case, in which the mark transfer tape has pressure-sensitive adhesive transfer marks disposed and held continuously at specific intervals peelably on the surface of a base tape, the transfer marks are composed of various marks and overwriting blank spaces, division bodily sensing means showing division positions of transfer marks is disposed between transfer marks, and bodily sensing engaging parts to be engaged with the division bodily sensing means of the mark transfer tape are disposed on the tape running area of the transfer head.

In a preferred embodiment, at least the surface forming portion of the overwriting blank spaces is made of a material to be written by a writing tool.

The following modes may be employed in the division bodily sensing means and bodily sensing engaging parts.

(1) The division bodily sensing means is a bodily sensing sliding part formed between mutually adjacent transfer marks in the mark transfer tape, and the bodily sensing engaging part is the leading edge of the transfer head, and when the bodily sensing sliding part is engaged with the leading edge of the transfer head in the mark transfer operation, a sliding phenomenon occurs in this engaging position, and the transfer complete position of one transfer mark is known by bodily sensation.

(2) The division bodily sensing means is a bodily sensing recess formed between mutually adjacent transfer marks in the mark transfer tape, and the bodily sensing engaging part is a leading edge of the transfer head, and when the bodily sensing recess is engaged with the leading edge of the transfer head in the mark transfer operation, a hooking phenomenon occurs in the running operation of the mark transfer tape, and the transfer complete position of one transfer mark is known by bodily sensation.

(3) The division bodily sensing means is a bodily sensing recess formed between mutually adjacent transfer marks in the mark transfer tape, and the bodily sensing engaging part is a positioning bump provided on the transfer head, and when the bodily sensing recess is engaged with the positioning bump provided on the transfer head in the mark transfer operation, a hooking phenomenon occurs in the running operation of the mark transfer tape, and the transfer complete position of one transfer mark is known by bodily sensation.

(4) The division bodily sensing means includes a plurality of bodily sensing bumps formed between mutually adjacent transfer marks in the mark transfer tape, and the bodily sensing engaging part is a positioning bump provided on the transfer head, and when the positioning bump is engaged between the plurality of bodily sensing bumps in the mark transfer operation, a hooking phenomenon occurs in the running operation of the mark transfer tape, and the transfer complete position of one transfer mark is known by bodily sensation.

The basic composition of operation of the mark transfer tool is either a refill type having a tape cartridge comprising at least the pay-out reel and take-up reel detachably disposed in the case so that the mark transfer tape may be exchanged, or a onetime type having the pay-out reel and take-up reel disposed in the case, with the transfer head provided at the leading end of the case.

The mark transfer tape of the invention is preferably disposed and used in the mark transfer tool, that is, a mark transfer tape disposed and used in the mark transfer tool for transferring a transfer mark on a sheet of paper or the like, in which pressure-sensitive adhesive transfer marks are disposed and held continuously at specific intervals peelably on the surface of a base tape, the transfer mark is composed of marks and overwriting blanks pace, and further division bodily sensing means showing division positions of transfer marks is disposed between transfer marks, and the division bodily sensing means is configured to indicate the division position of one transfer mark by bodily sensation when engaged with the bodily sensing engaging part provided on the transfer head of the mark transfer tool in the mark transfer operation of the mark transfer tool.

In a preferred embodiment, at least the surface forming portion of the overwriting blank spaces is made of a material to be written by a writing tool.

Further, the mark transfer tape of the invention is composed of a transfer mark layer comprising multiple transfer marks adhered and held to the surface side of the base tape of which back side is processed to be peelable, peelably or peelably and detachably in pieces, and more specifically the following lamination structure is employed.

i) The transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape processed to be peelable, peelably and detachably in pieces through the pressure-sensitive adhesive layer.

ii) The transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark forming layer.

iii) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark array layer.

iv) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be adhesive, peelably and detachably in pieces through the mark array layer.

Further, as the division bodily sensing means, the following modes may be employed.

(a) The division bodily sensing means is a bodily sensing sliding part formed of the surface of the base tape between mutually adjacent transfer marks, and when the bodily sensing sliding part is engaged with the leading edge of the transfer head of the mark transfer tool in the mark transfer operation, a sliding phenomenon occurs between the bodily sensing sliding part and the correction area, and the transfer complete position of one transfer mark is known by bodily sensation.

(b) The division bodily sensing means is a bodily sensing sliding part formed of the surface of the transfer mark layer, corresponding to mutually adjacent transfer marks, and when the bodily sensing sliding part is engaged with the leading edge of the transfer head of the mark transfer tool in the mark transfer operation, a sliding phenomenon occurs between the bodily sensing sliding part and the correction area, and the division position of one transfer mark is known by bodily sensation.

(c) The division bodily sensing means is a bodily sensing recess formed on the base tape corresponding to mutually adjacent transfer marks, and when the bodily sensing recess is engaged with the leading edge of the transfer head in the mark transfer operation, a hooking phenomenon occurs in the running operation of the mark transfer tape, and the transfer complete position of one transfer mark is known by bodily sensation.

(d) The division bodily sensing means is a bodily sensing recess formed between mutually adjacent transfer marks on the back side of the base tape, and when the bodily sensing recess is engaged with the bodily sensing engaging part provided on the transfer head of the mark transfer tool in the mark transfer operation, a hooking phenomenon occurs in the running operation of the tape, and the division position of one transfer mark is known by bodily sensation.

(e) The division bodily sensing means includes a plurality of bodily sensing bumps formed between mutually adjacent transfer marks in the mark transfer tape, and when the bodily sensing engaging part provided on the transfer head of the mark transfer tool is engaged between the plurality of bodily sensing bumps in the mark transfer operation, a hooking phenomenon occurs in the running operation of the tape, and the transfer complete position of one transfer mark is known by bodily sensation.

To transfer the transfer mark on the mark transfer tape on a desired correction area of a sheet of paper, the case is held by fingers, the leading end pressing portion of the transfer head is pressed tightly to the correction area, and the case is moved along the sheet of paper in this state, so that the transfer mark is transferred.

Specifically, with the division bodily sensing means provided in the mark transfer tape engaged with the bodily sensing engaging part of the transfer head, the transfer head is tightly pressed to the transfer start end on the correction area, and the case is directly moved along the sheet of paper, and next division bodily sensing means is engaged with the bodily sensing engaging part, and is stopped when a sliding phenomenon occurs in the engaging part or when a hooking phenomenon occurs in the running operation of the mark transfer tape.

By this operation, the transfer mark on the mark transfer tape at the leading end pressing portion of the transfer head is peeled off the base tape, and is accurately transferred on the correction area, and the used mark transfer tape after the transfer mark is separated, that is, the base tape is taken up and collected on the take-up reel.

After transfer, it is allowed to write over by a writing tool in the overwriting blank space of the transfer mark.

Further, after transfer, it is allowed to write over by a writing tool in the overwriting blank space of the transfer mark.

These and other objects and features of the invention will be more clearly understood by reading the following detailed description taken in conjunction with the accompanying drawings and novel facts disclosed in the claims thereof.

DETAILED DESCRIPTION OF THE PREFERRED EMBODIMENTS

Figure 1:
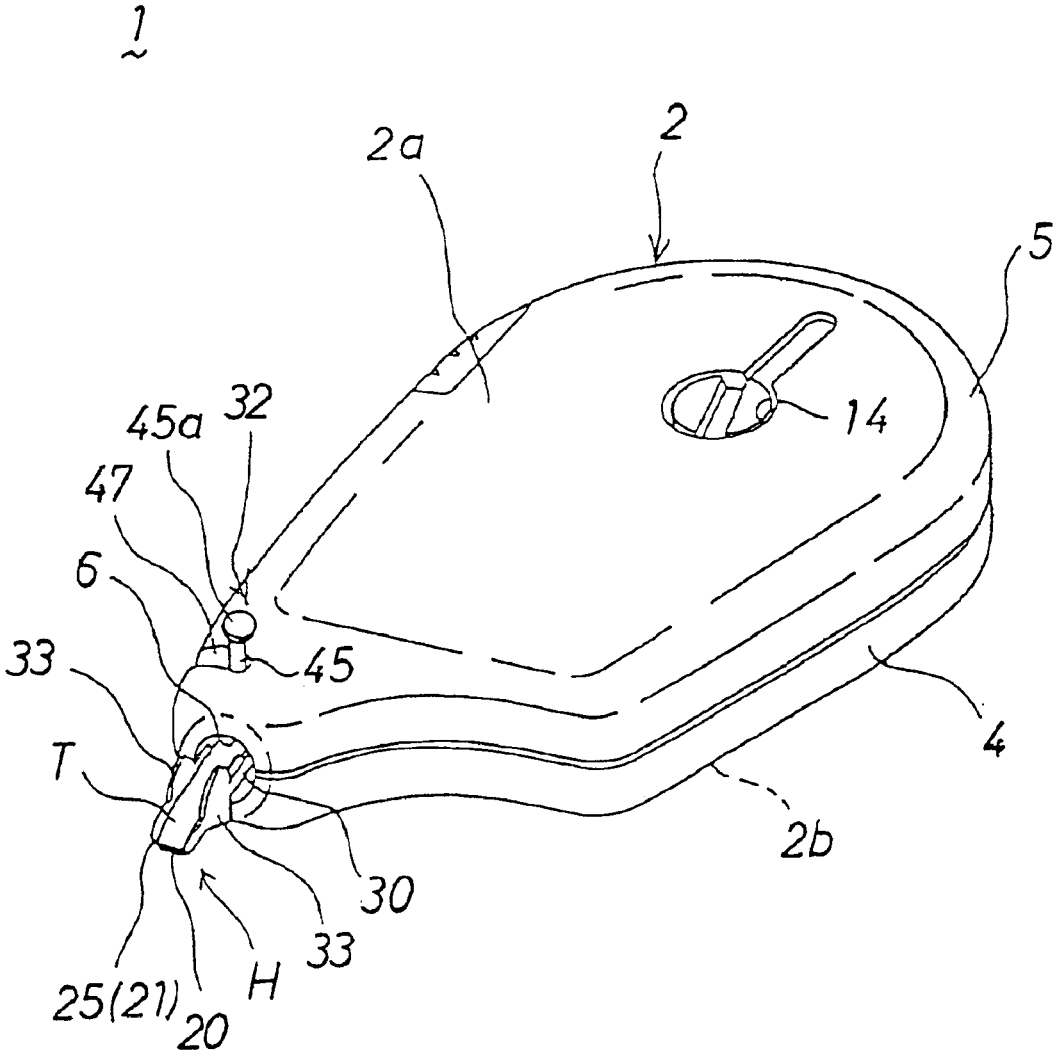
FIG. 1 is a perspective view showing a mark transfer tool in embodiment 1 of the invention.

Referring now to the drawings, preferred embodiments of the invention are described in detail below.

FIG. 1 through FIGS. 26A–26C show the mark transfer tool according to the invention, and same reference numerals indicate same constituent members or elements throughout the entire drawings.

Embodiment 1

The mark transfer tool according to this embodiment is shown in FIG. 1 to FIGS. 8A–8C. This mark transfer tool 1 is, specifically, to transfer marks M, M, . . . in a thin film on a mark transfer tape T, and it is a tape refill type having a cartridge structure allowing to exchange the mark transfer tape T as a consumable part.

Figure 2:
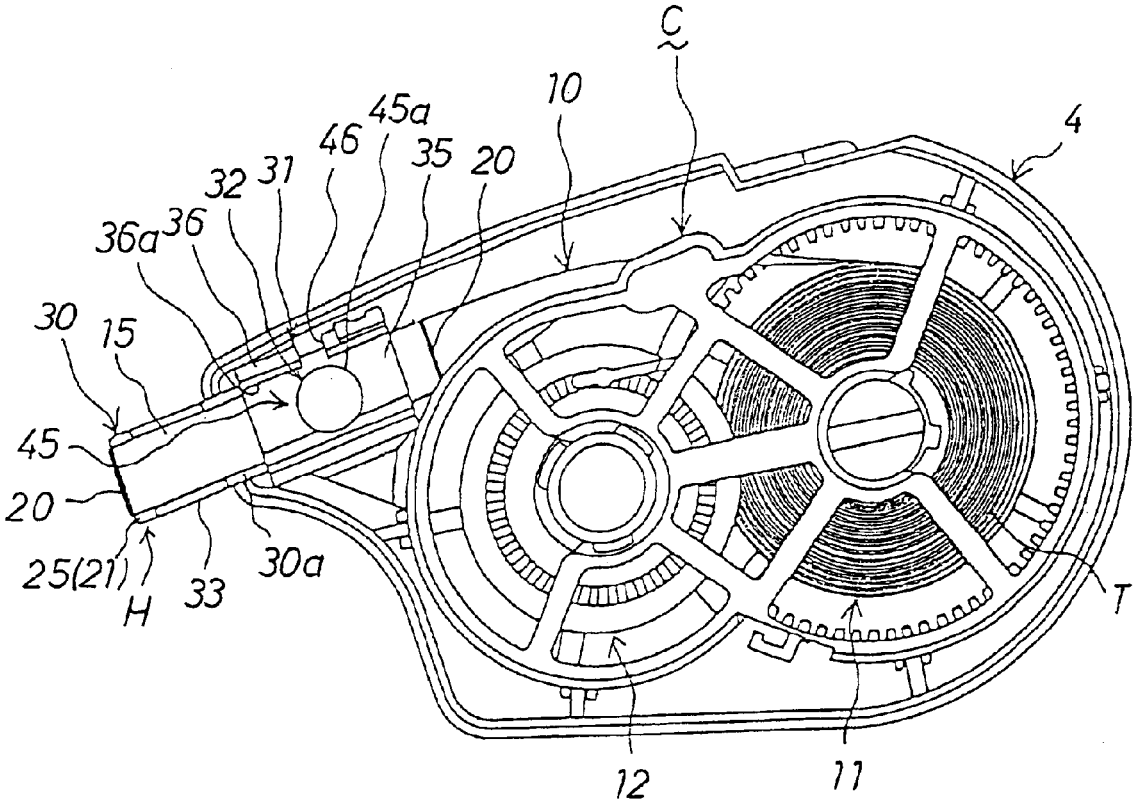
FIG. 2 is a front view showing the inside of a case main body of the mark transfer tool.
Figure 3:
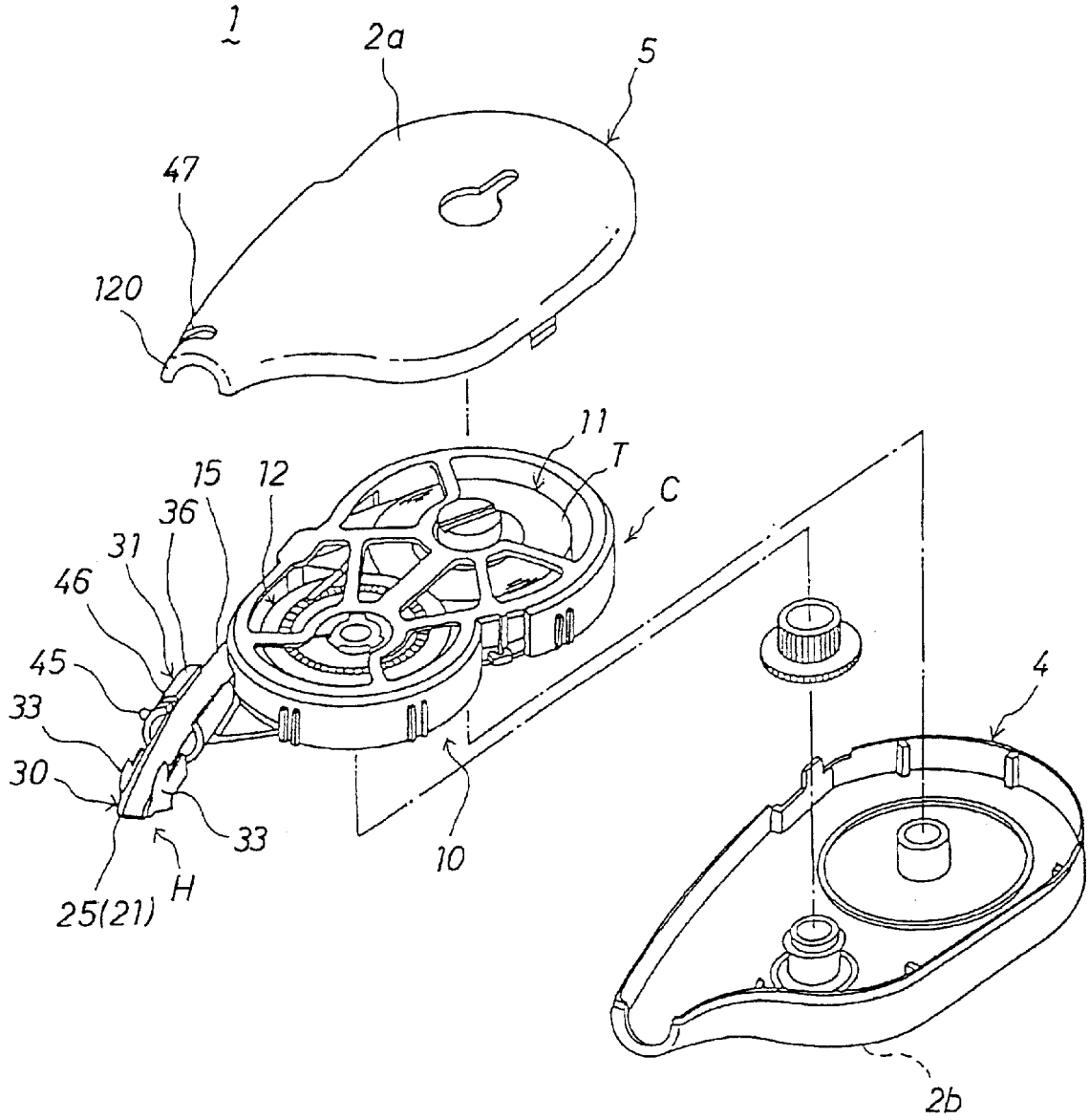
FIG. 3 is a perspective exploded view of the mark transfer tool.

That is, the mark transfer tool 1 comprises a case 2 having an appearance as shown in FIG. 1, and a tape cartridge C having a transfer head H as shown in FIG. 2 and FIG. 3.

The transfer mark M is composed of a mark Ma of arranged characters, codes, patterns or their combination, and an overwriting blank space Mb allowing to be written over by a writing tool. More specifically, as shown in FIG. 4B, the mark Ma is a designed alphabetical letter FAXED, and the overwriting blank space Mb is a blank space matched in shape with the FAXED mark Ma (inside of a nearly elliptical frame), and the date is entered in this overwriting blank space Mb.

The case 2 is held and manipulated by one hand, and is a flat box having a front contour shape and dimension and width enough to incorporate the tape cartridge C, and its confronting pair of flat face and back sides 2*a*, 2*b* are standard gripping sides when holding and manipulating by one hand. The case 2 is a plastic structure integrally formed by injection molding or the like, and a case main body 4 and a cap body 5 are separate, and the tape cartridge C is detachably inserted in the case main body 4. At the leading end of the case 2, a head inserting portion 6 for inserting the transfer head H in and out is formed.

The tape cartridge C is an exchangeable consumable part. The tape cartridge C consists of a pay-out reel 11 on which a mark transfer tape T is wound, and a rotatable take-up reel 12 for collecting the mark transfer tape T after use, which are rotatably installed in a cartridge case 10, and further a transfer head H for pressing and transferring the mark transfer tape T to the correction area is installed rotatably about the head axial center.

Although not specifically shown in the drawing, the tape cartridge C further includes a tape interlocking unit for mutually interlocking the pay-out reel 11 and take-up reel 12, a clutch mechanism for synchronizing the pay-out speed and take-up speed of the mark transfer tape T in the pay-out reel 11 and take-up reel 12, and other principal and basic components, which are assembled as a unit.

The cartridge case 10 is made of synthetic resin in a form of a cartridge case for accommodating the both reels 11, 12, and its shape and dimensions are set to be lightweight and compact in a range of having holding functions of both reels 11, 12, and more specifically it is a skeletal structure mainly composed of thin skeletal members.

The mark transfer tape T is to supply transfer marks M continuously, and pressure-sensitive adhesive transfer marks M are disposed and held on the surface of a base tape 15 continuously and peelably at specified intervals. Between the transfer marks M, M, division bodily sensing means 20 showing the division position of transfer marks M is disposed, and corresponding to this, at the tape traveling part of the transfer head H, a bodily sensing engaging part 21 to be engaged with the division bodily sensing means 20 is provided.

Figure 5A:
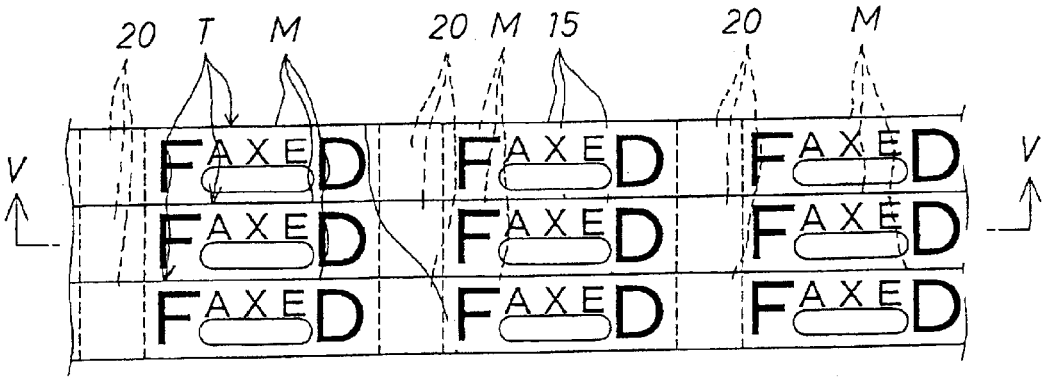
FIG. 5A is a plan of mark transfer tape of the mark transfer tool, showing a partially cut-away view of the mark transfer tape in the manufacturing process.
Figure 5B:
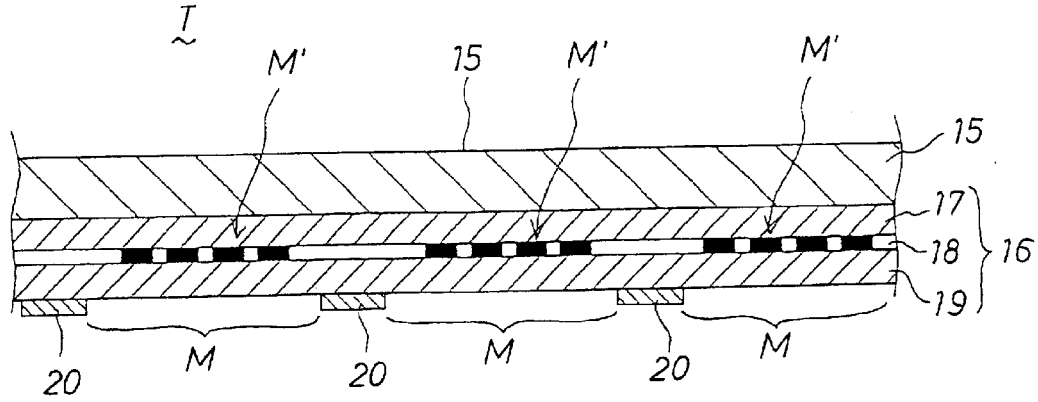
FIG. 5B is a sectional view along line V—V in FIG. 5A of the mark transfer tape.
Figure 5C:
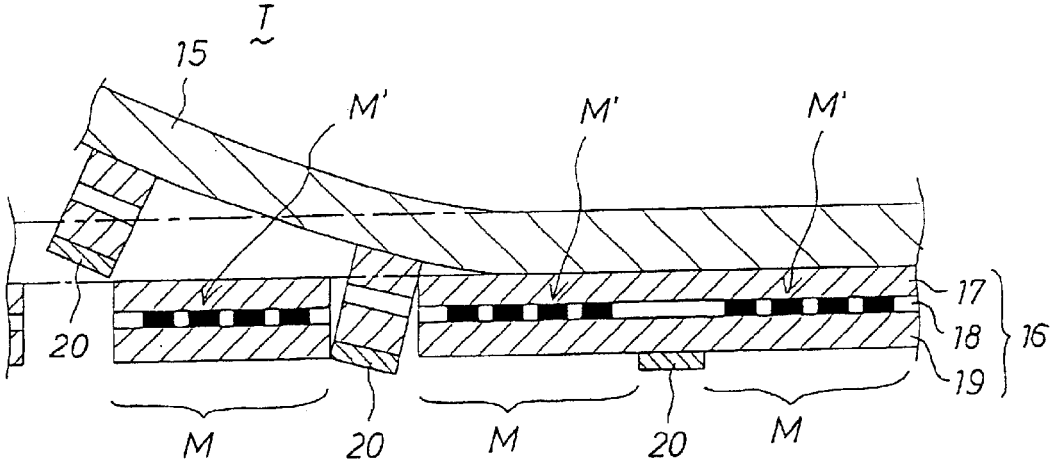
FIG. 5C is a sectional view showing a peeling state of base tape and transfer mark layer of the mark transfer tape.

In the shown embodiment, the mark transfer tape T has a sectional structure as shown in FIGS. 5A–5C, and on the surface of the base tape 15 (the lower side in FIG. 5B and FIG. 5C), a transfer mark layer 16 composed of multiple transfer marks M, M, . . . is peelably adhered and held. Since the drawings are intended to help understanding, they are schematic and magnified in the thickness direction, but actually the mark transfer tape T is a thin film, and the boundary of layers is not so clear as illustrated.

The base tape 15 has its both face and back sides processed to be peelable, that is, it is a film tape made of plastic or paper material, having the surface treated to be separable or peelable from the adjacent layers or materials, and a non-stretchable flexible film is preferably used.

The transfer mark layer 16 is a laminate structure integrally laminating a mark forming layer 17, a mark array layer 18, and a pressure-sensitive adhesive layer 19. This transfer mark layer 16 is continuous over the overall length of the base tape 15, that is, the transfer marks M, M, . . . are formed continuously, and are properly cut off by transfer operation of the transfer head H at the time of mark transfer.

Quality requirements of the transfer mark layer 16, for example, include the following.

1) Transferring property: Ease of transfer of position of transfer mark layer 16 pressed by the transfer head H on the correction area.

2) Cutting performance: Ease of transfer and cutting of only the position of the transfer mark layer 16 pressed by the transfer head H (if the cutting performance of the transfer mark layer 16 is poor, the portion of the transfer mark layer 16 not intended to be transferred may be transferred).

3) Peeling resistance: Strength of sticking of transfer mark layer 16 to correction area.

4) Writing performance: Ease of writing by pencil, ball-point pen or other writing tool on the transferred transfer mark layer 16.

5) Aging stability: Freedom from discoloration or blurring of ink written by writing tool on the transferred transfer mark layer 16.

6) Smoothness: Smoothness of surface of transfer mark layer 16 after transfer.

Various compounds are combined in order to prove the transfer mark layer 16 with these quality characteristics depending on the purpose.

The mark forming layer 17 is intended to facilitate formation (specifically printing) of mark array layer 18, and has a function of adhering and holding the transfer mark layer 16 on the surface of the base tape 15, and a surface layer is formed after transfer of transfer mark M. The mark forming layer 17, in addition to these basic functions (forming function of mark array layer 18 and adhering and holding function of transfer mark layer 16), also has an overwriting function by a writing tool 130 (see FIG. 8A) such as ball-point pen on the overwriting blank space Mb, as the surface forming area of the transfer mark layer 16 after transfer of the transfer mark M.

For this purpose, the mark forming layer 17 is made of an adhesive transparent material for expressing these functions. That is, the mark forming layer 17 is preferably made of a transparent resin material of dry type suited to surface layer after parting, having a proper adhesion holding property on the parted surface of the base tape 15, and also allowing overwriting by a writing tool 60.

The mark forming layer 17 is made of synthetic resin or natural resin, and other additives may be used, such as surface active agent, aging retarder, light fastness stabilizer, or filler for improving the writing performance. Examples of synthetic resin and natural resin include acrylic resin, vinyl resin, polyester resin, urethane resin, epoxy resin, polyamide resin, olefin resin, rubber, styrene-butadiene copolymer, cellulose resin, and coumarone, and these resins are used either alone or in combination of two or more types in order to satisfy these quality requirements.

The mark array layer 18 is composed of multiple marks (in the shown example, mark Ma of designed alphabetical letter FAXED, and overwriting blank space Mb of a blank space matched in shape with this mark Ma) M', M', M', . . . arranged continuously and peelable at specific intervals in the running direction of the base tape 15, and is specifically formed on the mark forming layer 17 by a known printing technology.

The printing method of the mark array layer 18 includes various known printing techniques, specifically, traditional printing techniques such as typographic (relief) printing, offset printing, gravure (intaglio) printing, silk screen printing or tampon printing, and reverse roll coating, direct coating and other coater methods, spray coating, electrostatic coating, flow coating, roller coating, immersion coating, and further novel printing techniques such as laser printer, heat transfer, and ink jet printer systems, which may be properly selected depending on the properties of the forming object area (in the shown case, the mark forming layer 17).

The pressure-sensitive adhesive layer 19 is used to press and adhere the transfer mark layer 16 to the correction area, and to form a surface layer of mark transfer tape T before transfer, and this pressure-sensitive adhesive layer 19 is made of a pressure-sensitive transparent material. That is, the pressure-sensitive adhesive layer 19 is preferably made of a transparent see-through adhesive material of dry type suited to a surface layer before parting, having a pressure-sensitive adhesion to the correction area.

The pressure-sensitive adhesive layer 19 is made of adhesive component, and further adhesion regulator, aging retarder, or leveling agent may be blended. Examples of adhesive include acrylic resin, rosin, rubber, vinyl ether, polyurethane, styrene, and polyisobutylene.

Such laminated transfer mark layer 16 is, as shown in FIGS. 5A–5C, adhered and held on the surface (the lower side in FIG. 5B and FIG. 5C) of the base tape 15 processed for parting, peelably and separably through the mark forming layer 17.

The division bodily sensing means 20 is specifically, as shown in FIGS. 5A–5C, a bodily sensing sliding part printed and formed on the surface (the lower side in FIG. 5B and FIG. 5C) of the transfer mark layer 16, and its printing method is one of various conventional printing techniques same as in the case of the mark array layer 18.

This bodily sensing sliding part 20 is formed corresponding to the mutually adjacent transfer marks M, M of the transfer mark layer 16, and is formed, for example, by known printing process on the surface of the pressure-sensitive adhesive layer 19 in the transfer mark layer 16.

This bodily sensing sliding part 20 has the same sliding characteristics as the parting process applied to the surface and back sides of the base tape 15, covers the surface of the pressure-sensitive adhesive layer 19 to extinguish the pressure adhesion of this portion on the correction area. This bodily sensing sliding part 20 is made of a transparent parting material same as the mark forming layer 17 and pressure-sensitive adhesive layer 19.

The specific forming position of the bodily sensing sliding part 20 is set corresponding to the bodily sensing engaging part 21 of the transfer head H, and is set so as to indicate the division position of one transfer mark M, or the transfer completion position in the shown embodiment, by bodily sensation, when the bodily sensing sliding part 20 is engaged with the bodily sensing engaging part 21 in the mark transfer operation of the mark transfer tool 1 mentioned below to cause a sliding phenomenon in the engaging position.

The bodily sensing engaging part 21 corresponding to the bodily sensing sliding part 20 is set at the tape traveling part of the transfer head H, and in the shown embodiment, the leading edge of the transfer head H, that is, the leading end pressing portion 25 functions also as the bodily sensing engaging part 21.

Figure 4A:
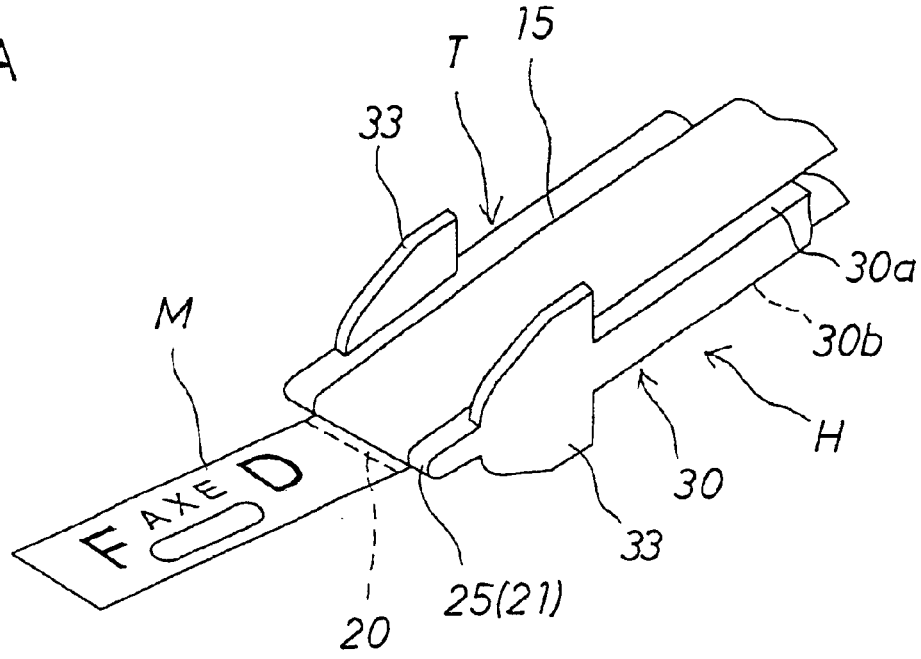
FIG. 4A is a perspective view showing essential parts of transfer head of the mark transfer tool.
Figure 4B:
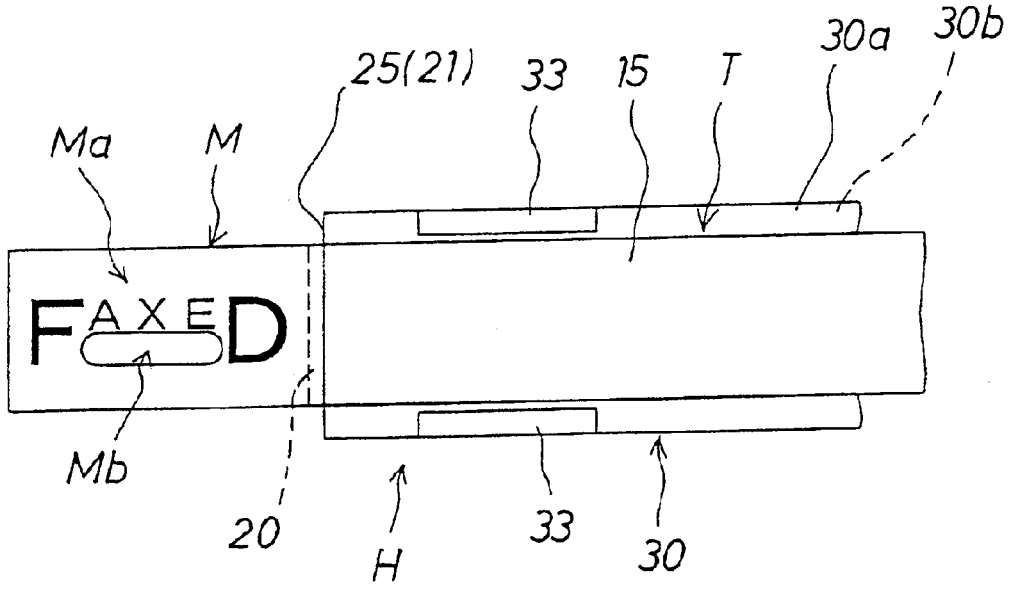
FIG. 4B is a plan showing essential parts of transfer head of the mark transfer tool.

That is, the mark transfer tape T paid out from the pay-out reel 11 is guided into the leading end pressing portion 25 along the tape traveling surface at one side of the transfer head H, and passes through the leading end pressing portion 25 and is inverted, and is further guided along the tape traveling surface of the opposite side, and taken up on the take-up reel 12, and as shown in FIG. 4A and FIG. 4B, the transfer completion position of one transfer mark M is indicated by bodily sensation when the bodily sensing sliding part 20 of the mark transfer tape T is engaged with the leading end pressing portion 25 (21) of the transfer head H to cause a sliding phenomenon in the engaging position.

More specifically, when the bodily sensing sliding part 20 of the mark transfer tape T is engaged with the leading end pressing portion 25 (21) of the transfer head H, sliding occurs between the bodily sensing sliding part 20 and the correction area, and running of the mark transfer tape T is stopped, and the mark transfer action is disabled, so that the user knows the transfer complete position of one transfer mark M by bodily sensation. To start transfer action of next transfer mark M, as mentioned below, while pressing the leading end pressing part 25 of the transfer head H somewhat firmly on the correction area preliminarily, by moving on the correction area, running of the mark transfer tape T is started again, so that the mark transfer action is enabled.

The mark transfer tape T in the shown embodiment is manufactured as a band having a tape width corresponding to a plurality of mark transfer tapes T, T, . . . as shown in FIG. 5A, and cut and formed in a width of one tape T by slitter or other cutting device.

According to a specific forming method of the transfer mark layer 16, the mark forming layer 17 is applied and formed on the surface of the base tape 15, the mark array layer 18 is printed and formed on the surface of the mark forming layer 17, and the pressure-sensitive adhesive layer 19 is applied and formed thereon, and finally the body sensing sliding part 20 is printed and formed on the surface of the pressure-sensitive adhesive layer 19.

The transfer head H presses the mark transfer tape T to a correction area on a sheet of paper, and it is disposed at the leading end of the cartridge case 10, and has a function of guiding the mark transfer tape T and a function of pressing.

A specific structure of the transfer head H comprises a head main body 30, a head holding portion 31, and a rotary operation portion 32, and the head main body 30 is held rotatably about its axial center, that is, a so-called rotary head structure is formed.

The head main body 30 is to press and transfer the mark transfer tape T, and is shaped to be suited to transfer accurately to a desired transfer position, that is, in a pointed form.

The head main body 30 in the shown example is a thin plate having a rectangular shape slightly wider than the mark transfer tape T, and has a taper section, being pointed in a side view so as to be gradually thin toward the leading end. The head main body 30 has flat both side surfaces 30*a*, 30*b*, which form tape running surfaces, and a leading edge 25 is a leading end pressing portion for pressing the mark transfer tape T as mentioned above, and functions also as the bodily sensing engaging part 21. This leading end pressing portion 25 is a straight edge orthogonal to the tape running direction in the tape running surfaces 30*a*, 30*b*. At both side edges of the head main body 30, guide flanges 33, 33 are formed for guiding running of mark transfer tape T.

If the thickness of the plate for composing the head main body 30 is relatively small, tapering as shown in the drawing is not always necessary, but the plate thickness may be uniform throughout the longitudinal direction, and anyway the structure is not particularly specified as far as the leading end of the pressing portion of the head main body 30 has a thickness (a point) enough to position and indicate the transfer position accurately.

At the base end side portion of the head main body 30, further, a borne portion 35 is integrally formed as a main body support.

The head holding portion 31 supports the head main body 30 rotatably bout its axial center, and specifically comprises a borne portion 35 as the main body support, and a bearing 36 provided in the cartridge 10.

Figure 6A:
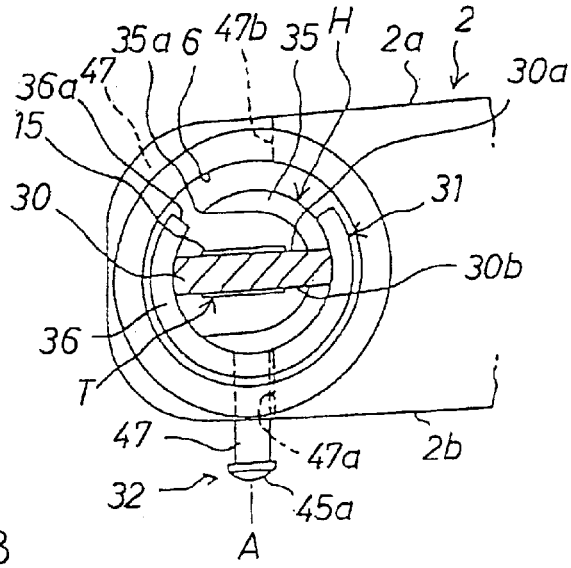
FIGS. 6A–6C are a magnified front view showing a partial section of rotating structure of transfer head for the mark transfer tool.
Figure 6B:
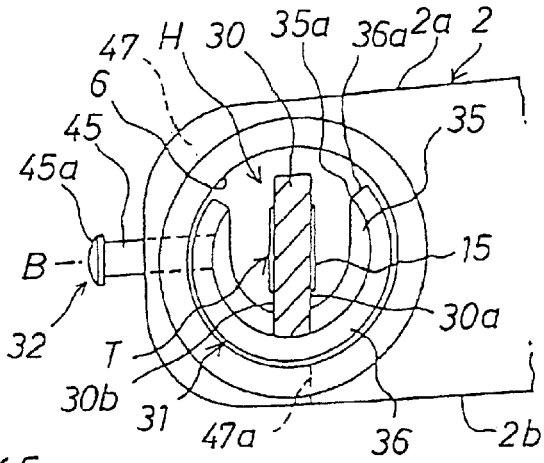
Figure 6C:
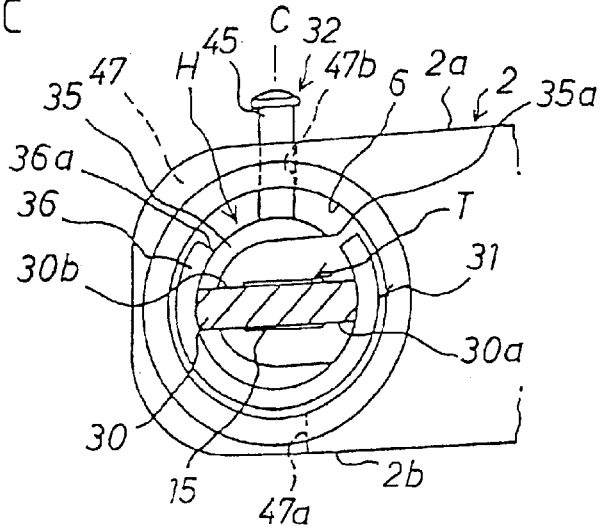

The borne portion 35 is, as shown in FIGS. 6A–6C., a cylindrical portion provided concentrically and integrally with the head main body 30, and more specifically it is formed in an arc section having a setting opening 35*a* of mark transfer tape T to the head main body 30 in a part thereof.

The bearing 36 is disposed integrally at the leading end of the cartridge case 10. As shown in FIGS. 6A–6C, the bearing 36 is tubular having an inner circumference corresponding to the outer circumference of the borne portion 35, and same as the borne portion 35, it is formed in an arc section having a setting opening 36*a* of mark transfer tape T to the head main body 30 in a part thereof. The born portion 35 is slidably supported on the bearing 36, and the head main body 30 is freely rotatable about the axial center in a specified rotating angle range described below.

The rotary operation portion 32 is to determine the rotating direction position of the head main body 30, and also serves as head position indicator to show the tape pressing and transferring position of the head main body 30.

The rotary operation portion 32 is a circular bar, and has an operation lever 45 including an operation knob 45*a* disposed at its leading end as a principal unit. The operation lever 45 is extended linearly outward in the radial direction from the axial center of the born portion 35, and projects to the outside of the case 2, through a slit inserting portion 46 and an operation guide portion 47 disposed at corresponding positions in the bearing 36 and case 2. In this case, the inserting portion 46 of the bearing 36 functions as a locking portion of the head main body 30 to prevent it from slipping out in the axial direction.

The location of the operation lever 45 in the rotating direction with respect to the head main body 30 is set in relation to the tape pressing and transferring position of the head main body 30, and the inserting portion 46 and operation guide portion 47 are extended in the peripheral direction so as to allow moving of the operation lever 45 in the rotating direction of the head main body 30. In particular, the operation guide portion 47 of the case 2 defines the operating range in the rotating direction of the operation lever 45, and is configured to control the tape pressing and transferring position of the head main body 30.

The relation of the operation lever 45 and the tape pressing and transferring position of the head main body 30 is explained with respect to the operation guide portion 47. In the shown embodiment, the configuration of the operation guide portion 47 as the operation range defining portion in the rotating direction is set follows, referring to FIGS. 6A–6C.

(a) When the operation lever 45 is in contact with one end 47*a* of the operation guide portion 47, that is, in the vertical downward position (first defined position A shown in FIG. 6A), the head main body 30 of the transfer head H is located at an angular position for guiding its leading end pressing portion 25 so that the mark transfer tape T may be nearly opposite to the gripping surfaces 2*a*, 2*b* of the case 2, that is, the face and back sides of the mark transfer tape T may be directed nearly in the same direction as (parallel to) the gripping surfaces 2*a*, 2*b*.

Figure 7A:
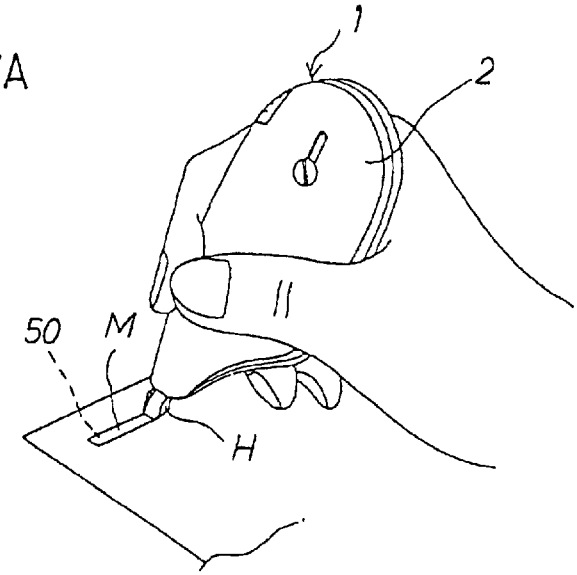
FIG. 7A is a perspective view of state of use of the mark transfer tool, showing a state of use of lateral pull by the right hand.

In this case, the new mark transfer tape T rolled out from the pay-out reel 11 is at the lower side of the head main body 30, and is in a state suited to use by lateral pull by a right-handed user (see FIG. 7A).

(b) When the operation lever 45 is at an intermediate position between both ends 47*a*, 47*b* of the operation guide portion 47 of the operation lever, that is, in the horizontal downward position (second defined position B shown in FIG. 6B), the head main body 30 of the transfer head H is located at an angular position for guiding its leading end pressing portion 25 so that the mark transfer tape T may remain in wound state on the pay-out reel 11 and take-up reel 12, that is, the face and back sides of the mark transfer tape T may be directed nearly in a nearly vertical direction (orthogonal) to the gripping surfaces 2*a*, 2*b*.

Figure 7B:
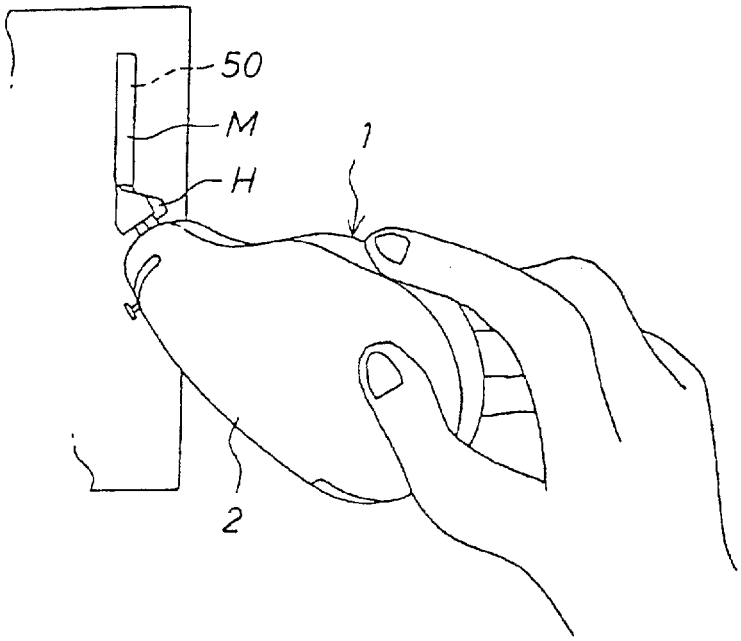
FIG. 7B is a perspective view of state of use of the mark transfer tool, showing a state of use of lateral pull by the left hand.

In this case, the new mark transfer tape T rolled out from the pay-out reel 11 is at the left side of the head main body 30, and is in a state suited to use by vertical pull (see FIG. 7B).

(c) When the operation lever 45 is in contact with other end 47*b* of the operation guide portion 47, that is, in the vertical upward position (third defined position C shown in FIG. 6C), the head main body 30 of the transfer head H is located at an angular position for guiding its leading end pressing portion 25 so that the mark transfer tape T may be nearly opposite to the gripping surfaces 2*a*, 2*b* of the case 2, in the upside down state of the case (a) above.

Figure 7C:
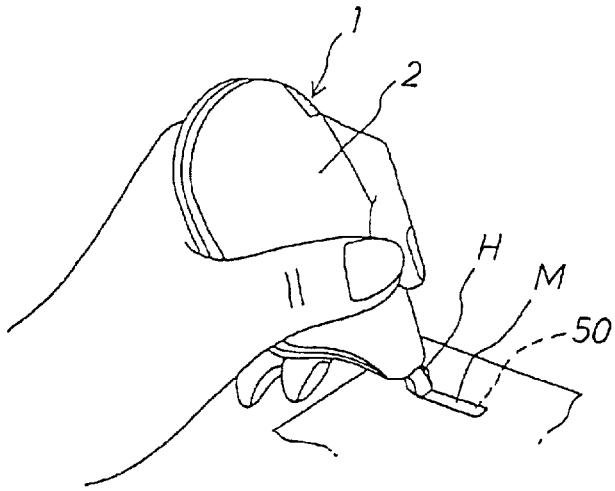
FIG. 7C is a perspective view of state of use of the mark transfer tool, showing a state of use of vertical pull by the right hand.

In this case, the new mark transfer tape T rolled out from the pay-out reel 11 is at the upper side of the head main body 30, and is in a state suited to use by lateral pull by a left-handed user (see FIG. 7C).

As clear from the description above, the direction of the operation lever 45 directly and visually shows the opposite direction of the new mark transfer tape T (function as head position indicator), and the user can confirm the tape pressing and transferring position of the head main body 30 by referring to the direction of the operation lever 45.

The rotating direction operating range of the operation guide portion 47 (nearly 180° at maximum in shown example) can be set in various desired values from a small angle range to a large angle range in consideration of relation between the operation lever 45 and the tape pressing and transferring position of the head main body 30.

Using the mark transfer tool 1 having such configuration, to transfer the transfer mark on the mark transfer tape onto a desired correction area 50 on a sheet of paper or the like, whether the user is right-handed or left-handed as mentioned above, the operation lever 45 can be rotated according to the purpose, and an optimum tape pressing and transferring position of the head main body 30 of the transfer head H (typically, first defined position A shown in FIG. 6A), second defined position B shown in FIG. 6B), or third defined position C shown in FIG. 6C) can be selected and set, and corresponding to this position, the case 2 can be gripped by fingers on the gripping surfaces (standard gripping surfaces are face and back sides 2*a*, 2*b* of the case 2, but proper positions or sides of the case 2 may be gripped depending on the purpose), so that various methods of use, for example, as shown in FIGS. 7A to 7C may be possible.

That is, in any method of use, the gripping surfaces of the case 2 are held like holding a writing tool, and the leading end pressing portion 25 of the transfer head H is pressed tightly to the transfer start end of the correction area 50 on a sheet of paper or the like, and the case 2 is moved along the sheet of paper by a specified distance and stopped.

More specifically, with the bodily sensing part 20 provided in the mark transfer tape T being engaged with the bodily sensing engaging part 21 of the transfer head H, that is, the leading end pressing portion 25, in other words, in the complete state of the previous mark transfer action, the transfer head H is tightly pressed to the transfer start end on the correction area 50, and the case 2 is directly moved along the sheet of paper, and is stopped when the next bodily sensing sliding part 20 is engaged with the bodily sensing engaging part 21 to cause a sliding phenomenon in the engaging position.

That is, as mentioned above, when the bodily sensing sliding part 20 of the mark transfer tape T is engaged with the leading end pressing portion 25 of the transfer head H, sliding occurs between the bodily sensing sliding part 20 and the correction area 50, and running of the mark transfer tape T is stopped, and the mark transfer action is disabled, so that the user knows the transfer complete position of one transfer mark M by bodily sensation.

By this operation, the transfer mark M of the mark transfer tape T in the leading end pressing portion 25 of the transfer head H is peeled from the base tape 15, and transferred onto the correction area 50, and the used mark transfer tape T after the transfer mark M is peeled off, that is, the base tape 15 is taken up and collected on the take-up reel 12. In this case, the portion of the transfer mark layer 16 disposing the bodily sensing sliding part 20 is not adhered to the correction area 50, but is left over on the base tape 15.

To start transfer action of next transfer mark M from this state, while pressing the leading end pressing part 25 of the transfer head H somewhat firmly on the correction area 50 preliminarily, by moving on the correction area, running of the mark transfer tape T is started again, so that the mark transfer action is enabled.

Figure 8A:
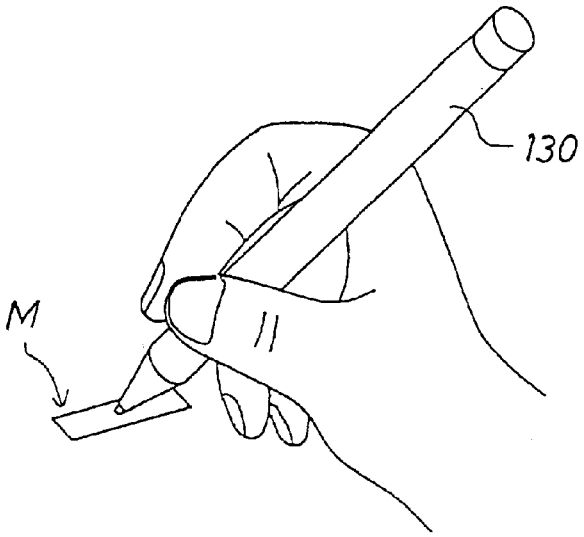
FIG. 8A is a perspective view showing an overwriting state by a writing tool after transfer mark by the mark transfer tool.

After the transfer mark M on the mark transfer tape T is transferred on the correction area 50, as shown in FIG. 8A, desires characters (the date in the shown case) can be written over by the writing tool 130 on the overwriting blank space Mb of the mark M.

Thus, the transfer mark M is composed of the mark Ma and overwriting blank space Mb, and therefore it is possible to write on a position of a material not written directly by the writing tool 130 or a material not erased cleanly if once written.

Since the mark transfer tool 1 of the embodiment has a cartridge structure for exchanging the mark transfer tape T, various transfer marks M, M, . . . depending on the purpose of use can be transferred and used by preparing a plurality of tape cartridges C having mark transfer tapes T of a plurality of types of transfer marks M, M.

Figure 8B:
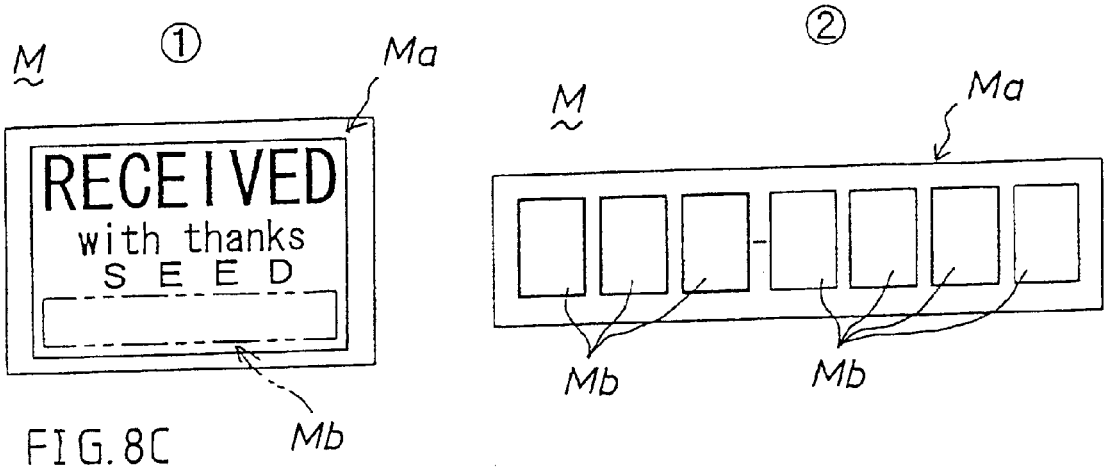
FIG. 8B is a plan showing a modified example of the transfer mark.
Figure 8C:
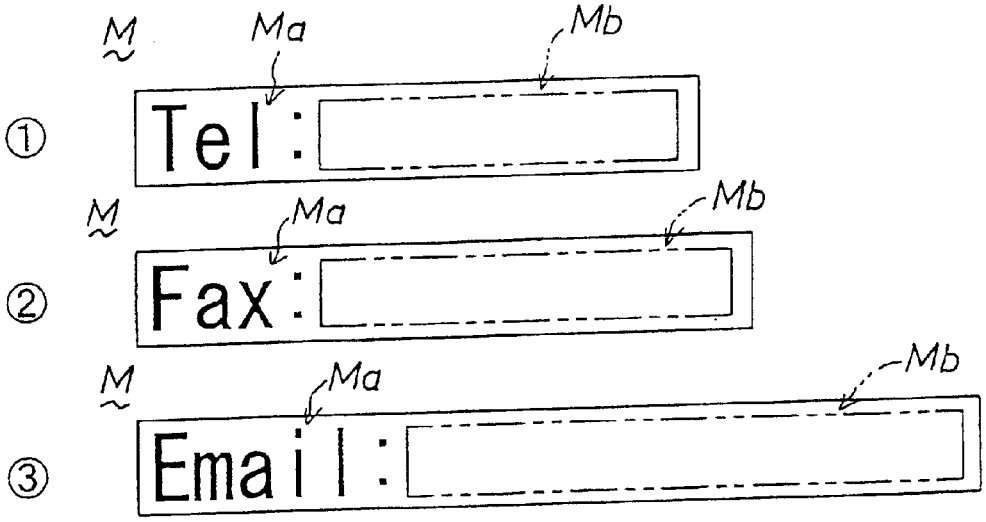
FIG. 8C is a plan showing other modified example of the transfer mark.

Other examples of the transfer mark M (mark Ma and overwriting blank space Mb) are shown in FIG. 8B and FIG. 8C.

That is, as shown in FIG. 8B, same as mentioned above, the mark Ma and overwriting blank space Mb are integrated, in which ① is composed of mark Ma "RECEIVED with thanks SEED) and matching overwriting blank space Mb for entering the date.

Further, ② has a rectangular mark Ma with seven overwriting blank spaces Mb consisting of with three cells enclosed with lines and four cells enclosed with thin lines for entering the Japanese postal system code (consisting of seven digits).

In FIG. 8C, ① is the mark Ma "Tel:" followed by blank entry space Mb at the right side for entering the telephone number.

Next Ad is the mark Ma "Fax:" followed by blank entry space Mb at the right side for entering the facsimile number.

Finally, ③ is the mark Ma "Email:" followed by blank entry space Mb at the right side for entering the e-mail address.

Embodiment 2

Figure 9A:
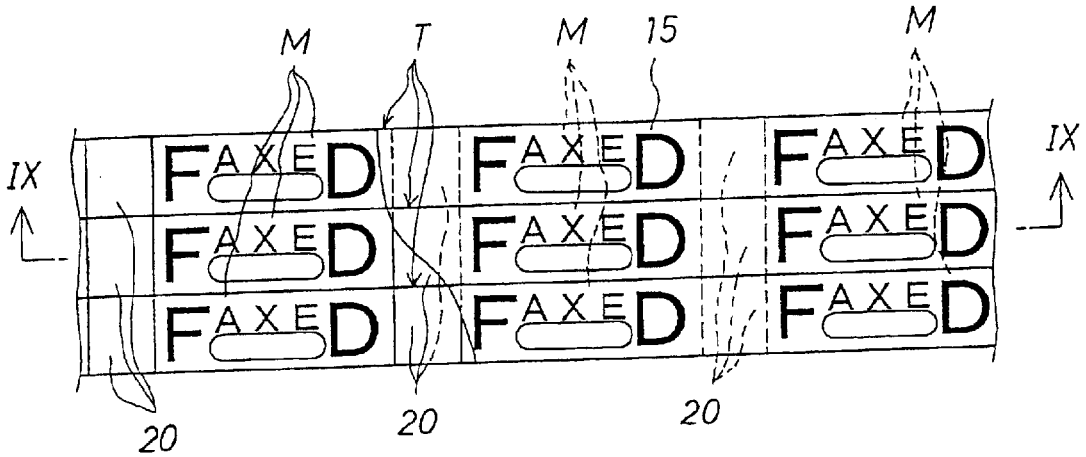
FIG. 9A is a plan of mark transfer tape of a mark transfer tool according to embodiment 2 of the invention, showing a partially cut-away view of the mark transfer tape in the manufacturing process.
Figure 9B:
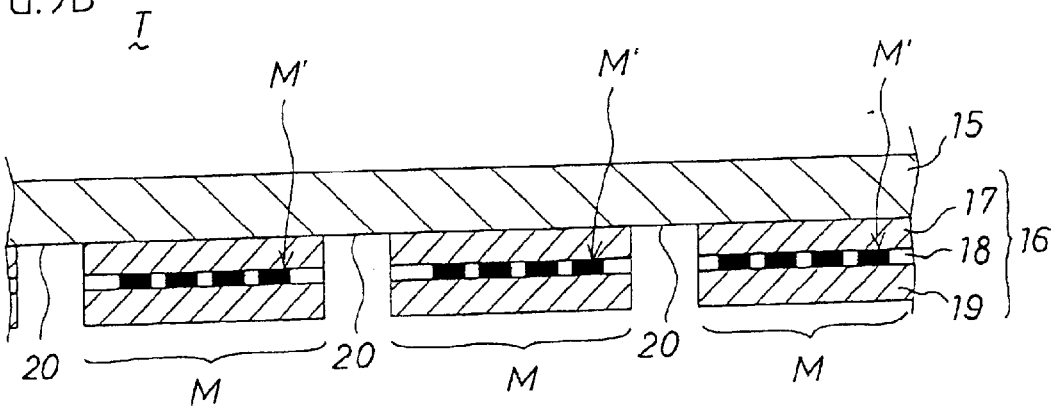
FIG. 9B is a sectional view along line IX—IX in FIG. 9A of the mark transfer tape.
Figure 9C:
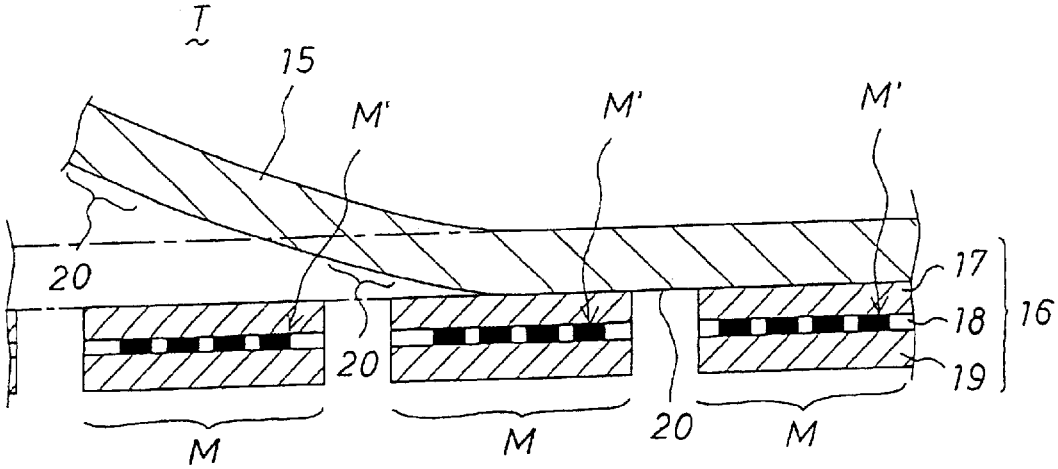
FIG. 9C is a sectional view showing a peeling state of base tape and transfer mark layer of the mark transfer tape.

This embodiment is shown in FIGS. 9A–9C, in which the structure of the mark transfer tape T in embodiment 1 is modified.

That is, in the mark transfer tape T of embodiment 1, as mentioned above, the transfer mark layer 16 is formed continuously over the entire length of the base tape 15, whereas in the mark transfer tape T of this embodiment, as shown in FIGS. 9A–9C, transfer marks M, N, . . . composing the transfer mark layer 16 are peelably adhered and held on the surface of the base tape 15 independently and at specific intervals.

The bodily sensing sliding part 20 is composed of the surface of the base tape 15 between the mutually adjacent marks M, M in the mark transfer layer 16.

In this configuration, by the same transfer operation as explained in embodiment 1, with the bodily sensing sliding part 20 being engaged with the bodily sensing engaging part 21 of the transfer head H, the leading end pressing portion 25 of the transfer head H is tightly pressed at the transfer start end of the correction area 50 on the sheet of paper, and the case 2 is directly moved along the sheet of paper, and is stopped when a sliding phenomenon occurs in the engaging position as the next bodily sensing sliding part 20 is engaged with the bodily sensing engaging part 21.

By this operation, only one transfer mark M of the mark transfer tape T is peeled from the base tape 15, and is transferred on the correction area 50.

To start transfer action of next transfer mark M from this state, while pressing the leading end pressing part 25 of the transfer head H somewhat firmly on the correction area 50 preliminarily, by moving on the correction area, running of the mark transfer tape T is started again, so that the mark transfer action is enabled.

The other configuration and operation are same as in embodiment 1.

Embodiment 3

Figure 10A:
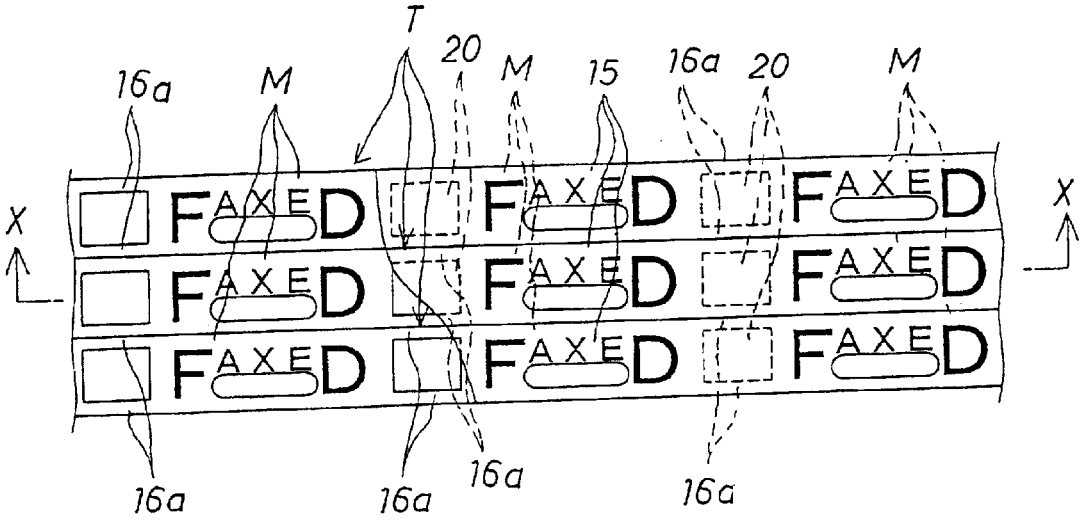
FIG. 10A is a plan of mark transfer tape of a mark transfer tool according to embodiment 3 of the invention, showing a partially cut-away view of the mark transfer tape in the manufacturing process.
Figure 10B:
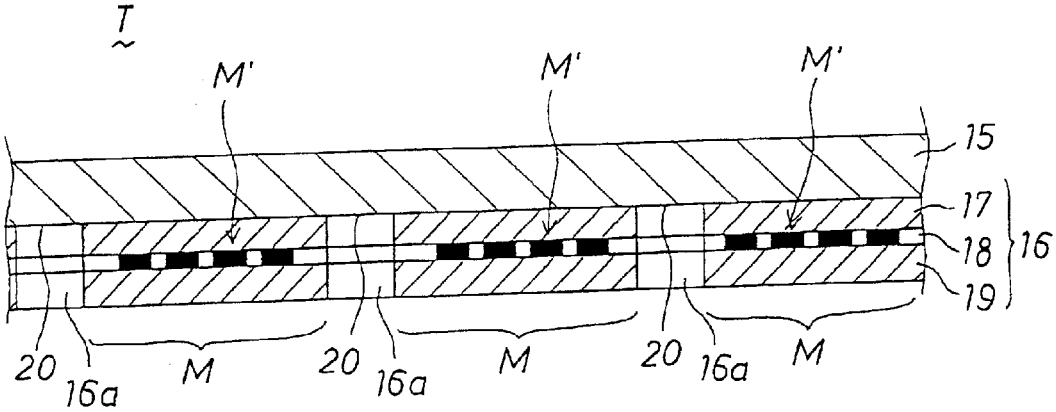
FIG. 10B is a sectional view along line X—X in FIG. 10A of the mark transfer tape.
Figure 10C:
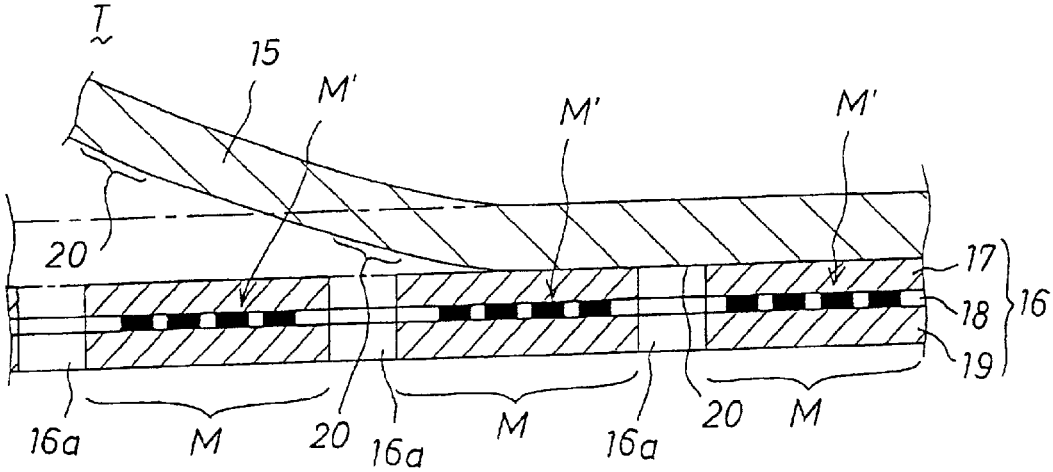
FIG. 10C is a sectional view showing a peeling state of base tape and transfer mark layer of the mark transfer tape.
Figure 11A:
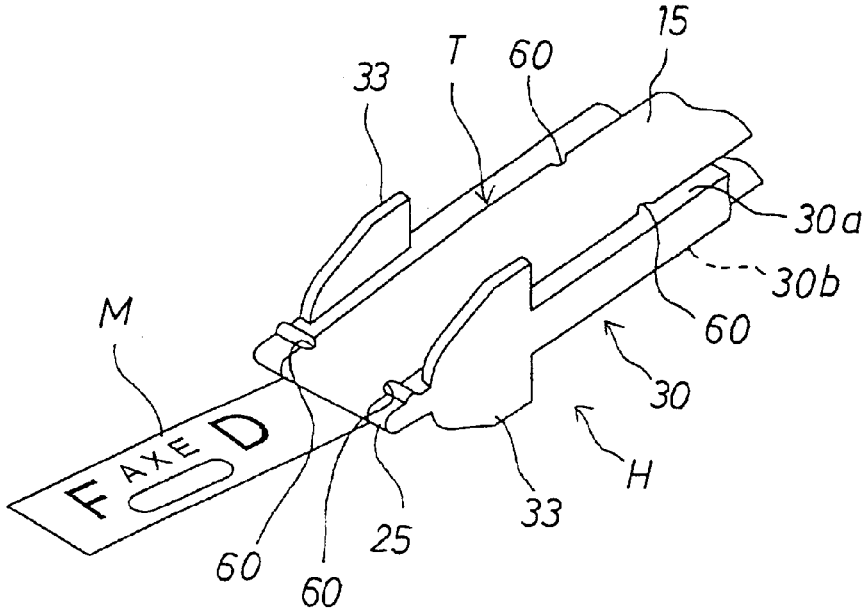
FIG. 11A is a perspective view showing essential parts of a transfer head of a mark transfer tool according to embodiment 4 of the invention.
Figure 11B:
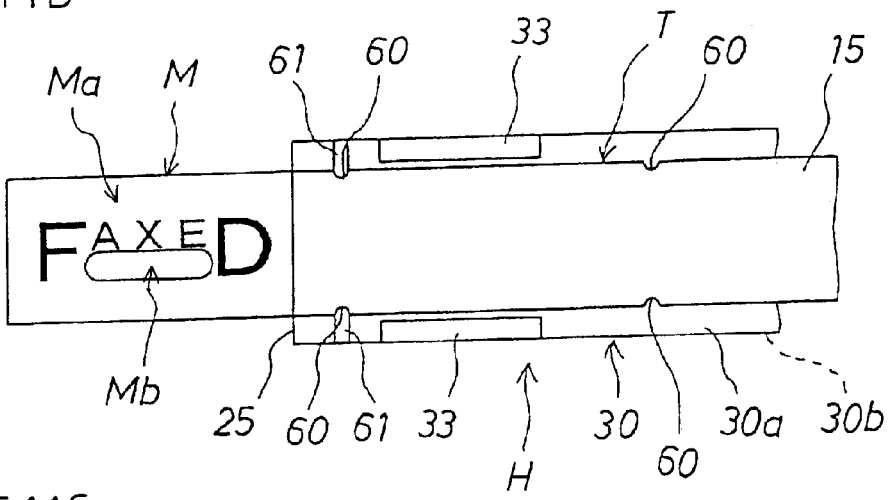
FIG. 11B is a plan showing essential parts of the transfer head.
Figure 11C:
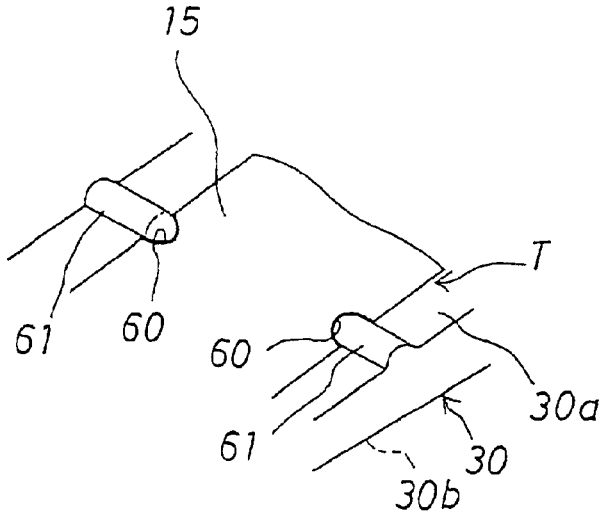
FIG. 11C is a partially magnified perspective view of essential parts of the transfer head.

This embodiment is shown in FIGS. 10A–10C, in which the specific structure of the mark transfer tape T in embodiment 2 is slightly modified.

That is, in the mark transfer tape T of the embodiment, transfer marks M, M, . . . composing the transfer mark layer 16 are peelably adhered and held on the surface of the base tape 15 independently and at specific intervals, and these transfer marks M, M are mutually coupled by means of a thin coupling layer 16*a*. The specific layer structure of this coupling layer 16*a* is same as that of the transfer mark layer 16, and is transparent. In the illustrated embodiment, the transfer marks M, M are mutually coupled by means of two thin coupling layers 16*a*, 16*a* at both side edges in the width direction.

The bodily sensing sliding part 20 is, same as in embodiment 2, composed of the surface of the base tape 15 between the mutually adjacent marks M, M in the mark transfer layer 16.

In this configuration, the transfer operation is same as in embodiment 2, but the transfer start action is easier when transferring a next transfer mark M after transferring one transfer mark M.

That is, since the mutually adjacent transfer marks M, M are coupled by means of two coupling layers 16*a*, 16*a*, when the bodily sensing sliding part 20 being engaged with the leading end pressing portion 25 of the transfer head H, sliding occurs between the bodily sensing sliding part 20 and correction area 50, part of the two coupling layers 16*a*, 16*a* is left over on the base tape 15 of the mark transfer tape T.

When starting transfer action of next transfer mark M, the remaining portion of the coupling layers 16*a*, 16*a* promotes restarting of running without causing sliding on the mark transfer tape T, so that the mark transfer action may be smoothly and securely started again.

The other configuration and operation are same as in embodiment 2.

Embodiment 4

This embodiment is shown in FIGS. 11A–11C and FIGS. 12A–12C, in which the specific structure of the mark transfer tape T in embodiment 1 is slightly modified.

That is, in the mark transfer tape T of this embodiment, division bodily sensing means 60 is a bodily sensing recess formed between mutually adjacent transfer marks M, M, and specifically it is a notch formed at least at one end in the width direction of the mark transfer tape T (both ends in the shown case). This notch 60 formed in an arc shape (semicircular in this case) in order to prevent breakage of the base tape 15 due to stress concentration.

Corresponding to this, a bodily sensing engaging part 61 provided in the transfer head H is a positioning bump so as to be engaged with the notch 60 in convex-concave relation.

This positioning bump 61 is provided at both sides in the width direction of the tape traveling surface 30*a* of the upper side for guiding running of used mark transfer tape T, that is, the base tape 15, of the tape traveling surfaces 30*a*, 30*b* of the head main body 30 of the transfer head H.

Specifically, the positioning bump 61 is a swollen bump integrally formed simultaneously with forming of the head main body 30, and the engaging part at the leading end has an arc contour shape corresponding to the notch 60. The location of the positioning bump 61 is slightly behind the leading end pressing portion 25, and is at both sides in the width direction of the mark transfer tape T.

In the mark transfer operation of the mark transfer tool 1, when the notches 60, 60 are engaged with the positioning bumps 61, 61, a hooking phenomenon occurs in the traveling action of the mark transfer tape T, and transfer complete position of one transfer mark M is known by bodily sensation.

The other configuration and operation are same as in embodiment 1.

Figure 12A:
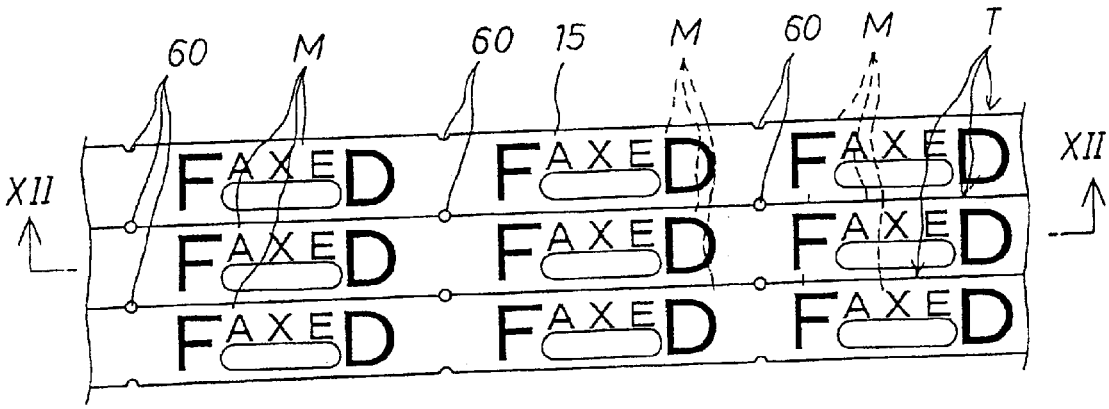
FIG. 12A is a plan of the mark transfer tape of the mark transfer tool, showing a partially cut-away view of the mark transfer tape in the manufacturing process.
Figure 12B:
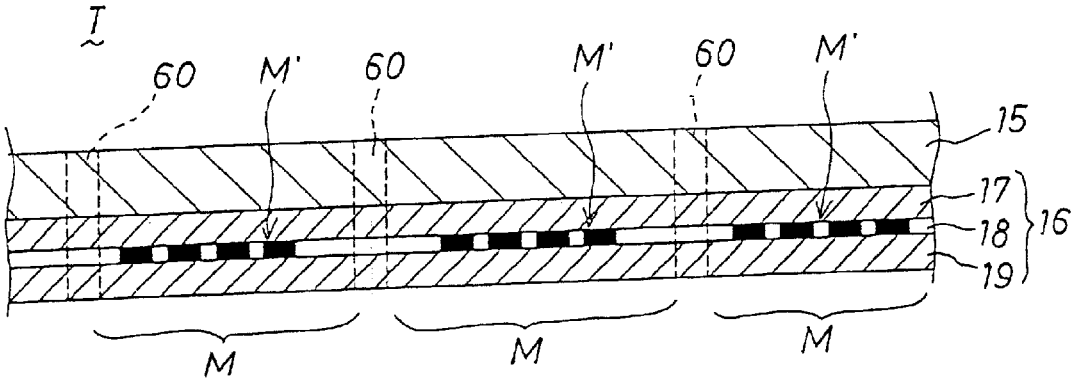
FIG. 12B is a sectional view along line XII—XII in FIG. 12A of the mark transfer tape.
Figure 12C:
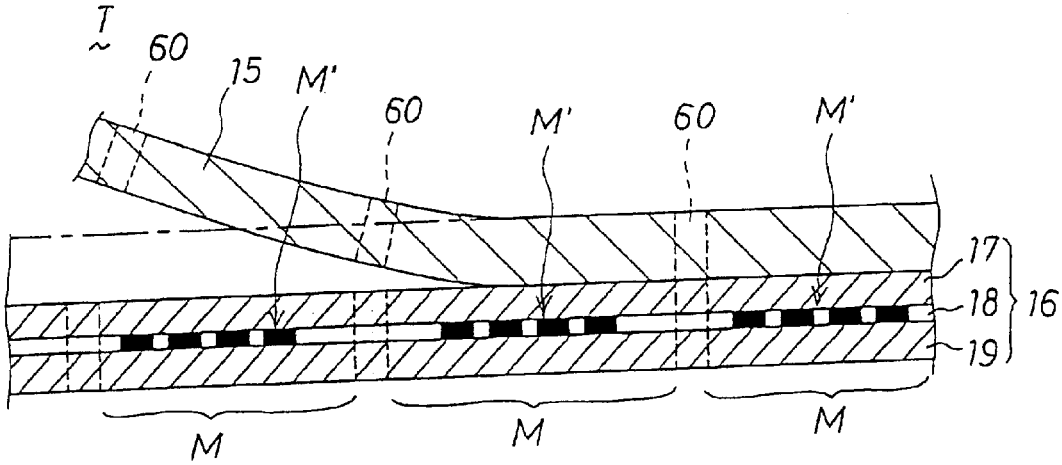
FIG. 12C is a sectional view showing a peeling state of base tape and transfer mark layer of the mark transfer tape.

The mark transfer tape T in this embodiment is, same as in embodiment 1, manufactured as a band having a tape width corresponding to a plurality of mark transfer tapes T, T, . . . as shown in FIG. 12A, and cut and formed in a width of one tape T by slitter or other cutting device.

Actually therefore, after the transfer mark layer 16 is formed on the surface side of the base tape 15, the division bodily sensing means 60 is pierced by punch or other piercing device, and therefore this division bodily sensing means 60 penetrates throughout the entire tape transfer tape T.

Embodiment 5

Figure 13A:
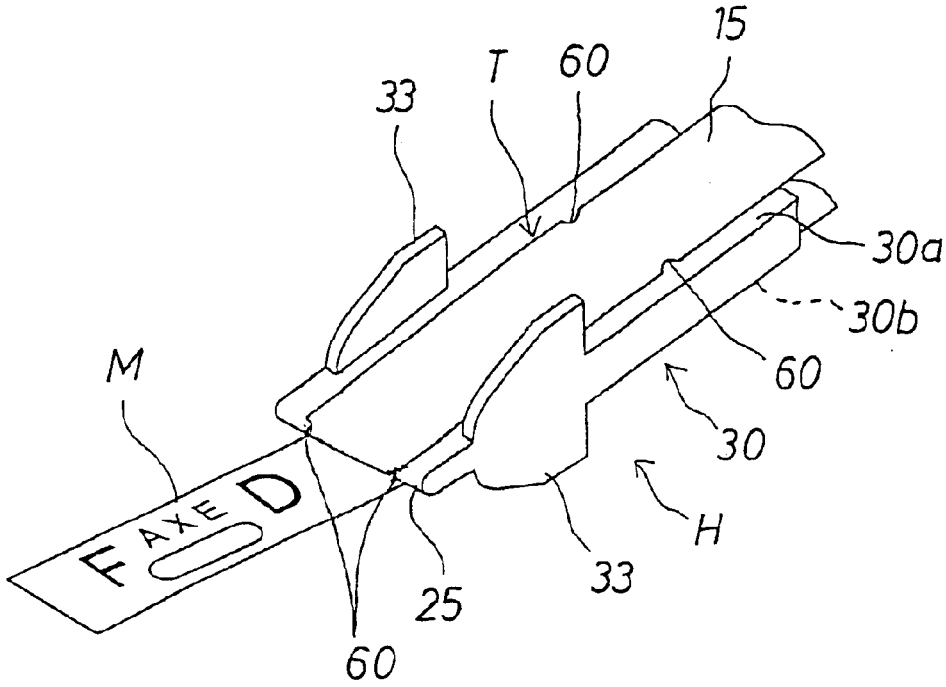
FIG. 13A is a perspective view showing essential parts of a transfer head of a mark transfer tool according to embodiment 5 of the invention.
Figure 13B:
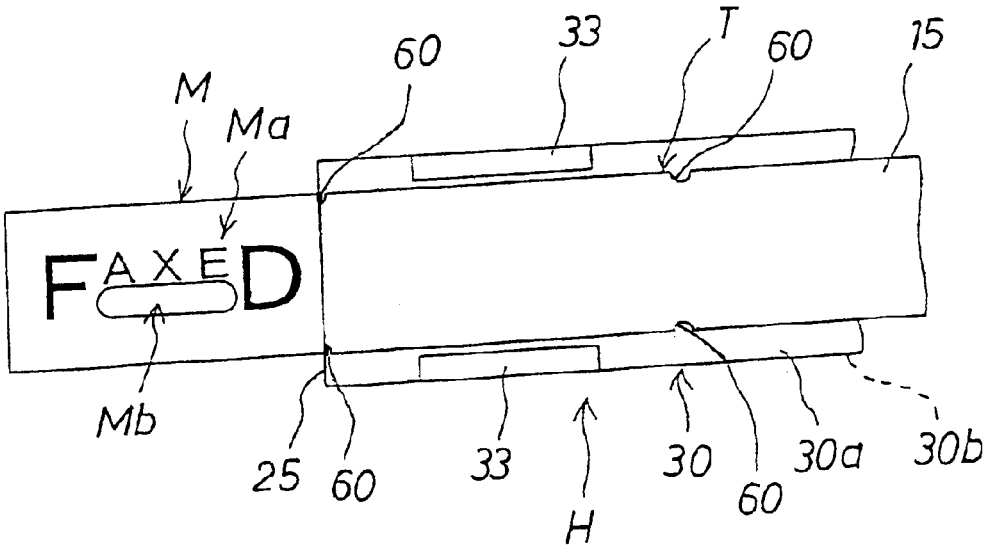
FIG. 13B is a plan showing essential parts of the transfer head.
Figure 14A:
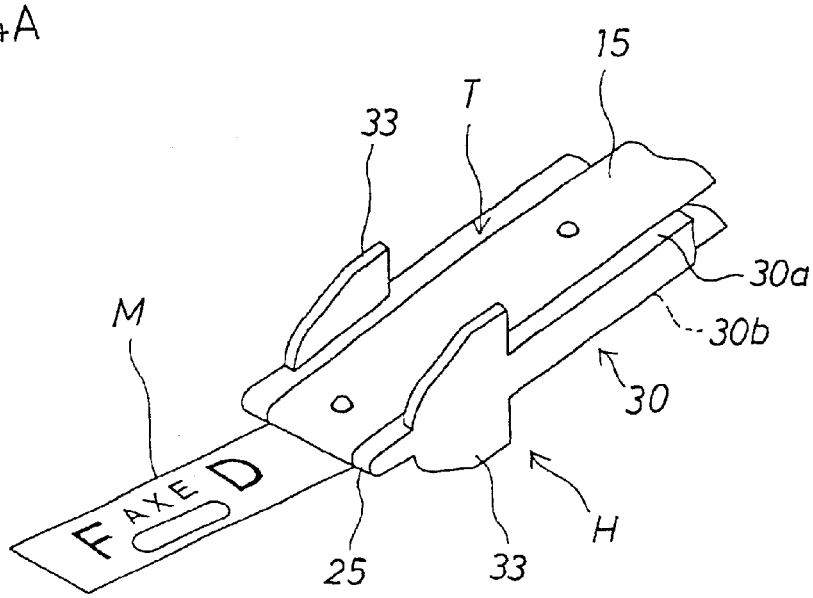
FIG. 14A is a perspective view showing essential parts of a transfer head of a mark transfer tool according to embodiment 6 of the invention.
Figure 14B:
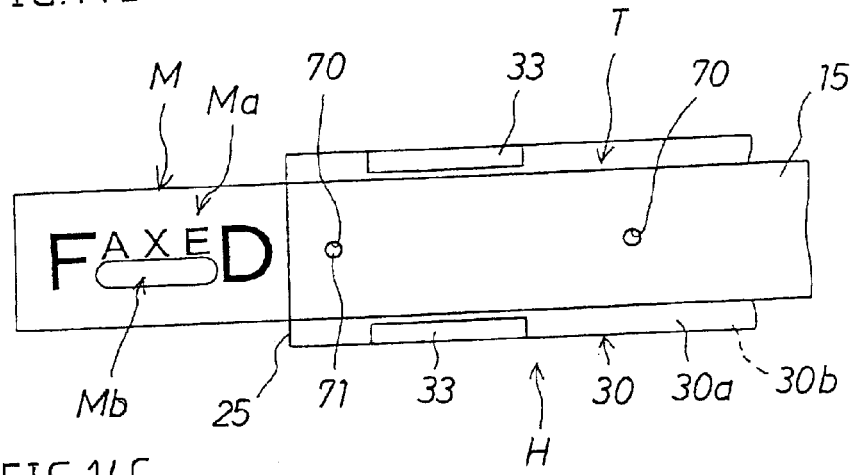
FIG. 14B is a plan showing essential parts of the transfer head.
Figure 14C:
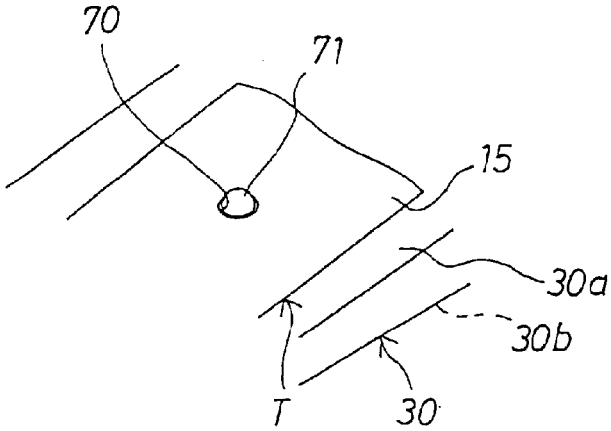
FIG. 14C is a partially magnified perspective view of essential parts of the transfer head.
Figure 15A:
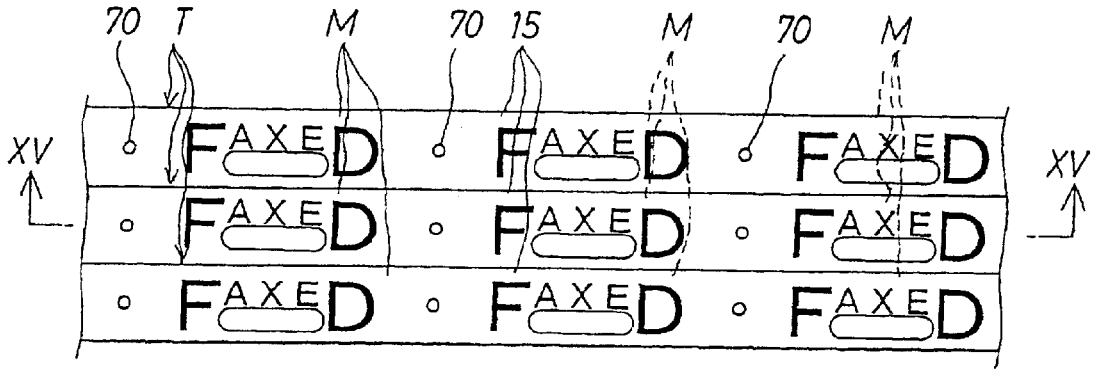
FIG. 15A is a plan of the mark transfer tape of the mark transfer tool, showing a partially cut-away view of the mark transfer tape in the manufacturing process.
Figure 15B:
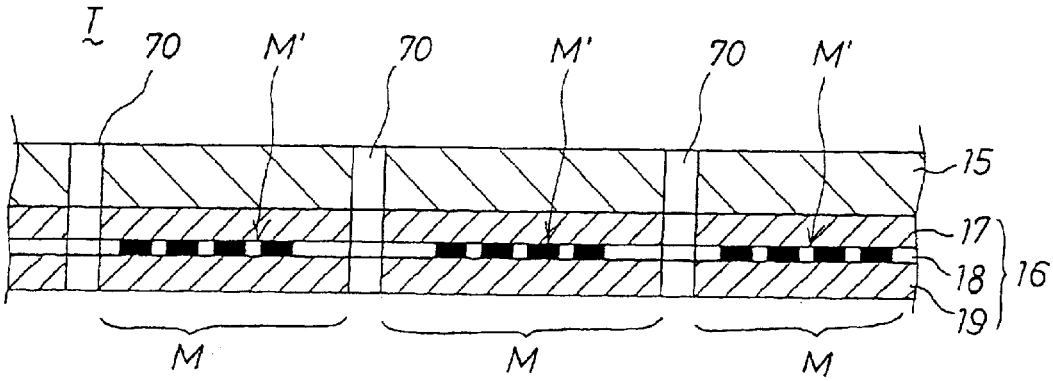
FIG. 15B is a sectional view along line XV—XV in FIG. 15A of the mark transfer tape.
Figure 15C:
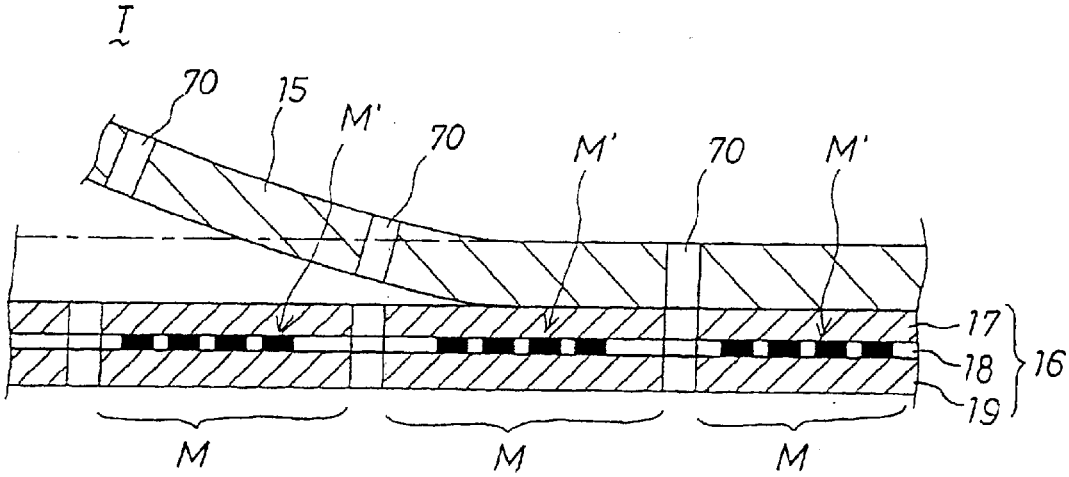
FIG. 15C is a sectional view showing a peeling state of base tape and transfer mark layer of the mark transfer tape.
Figure 16A:
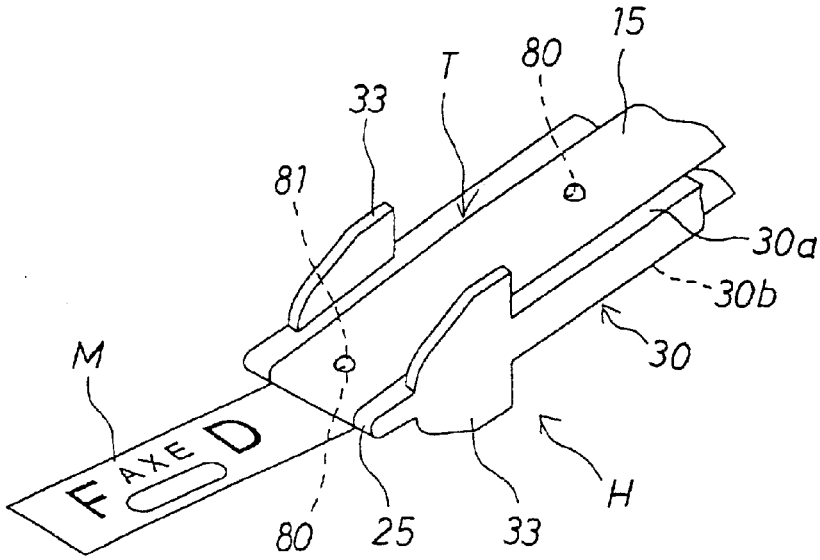
FIG. 16A is a perspective view showing essential parts of a transfer head of a mark transfer tool according to embodiment 7 of the invention.
Figure 16B:
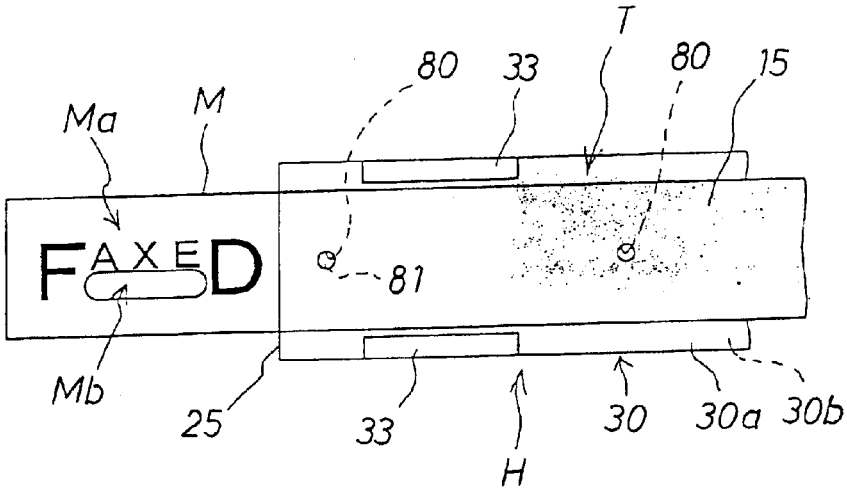
FIG. 16B is a plan showing essential parts of the transfer head.
Figure 16C:
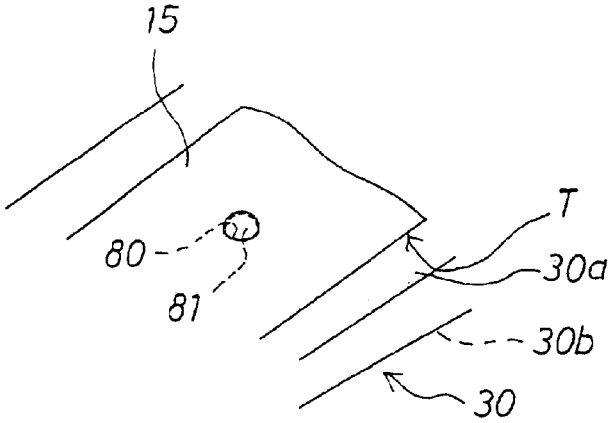
FIG. 16C is a partially magnified perspective view of essential parts of the transfer head.
Figure 17A:
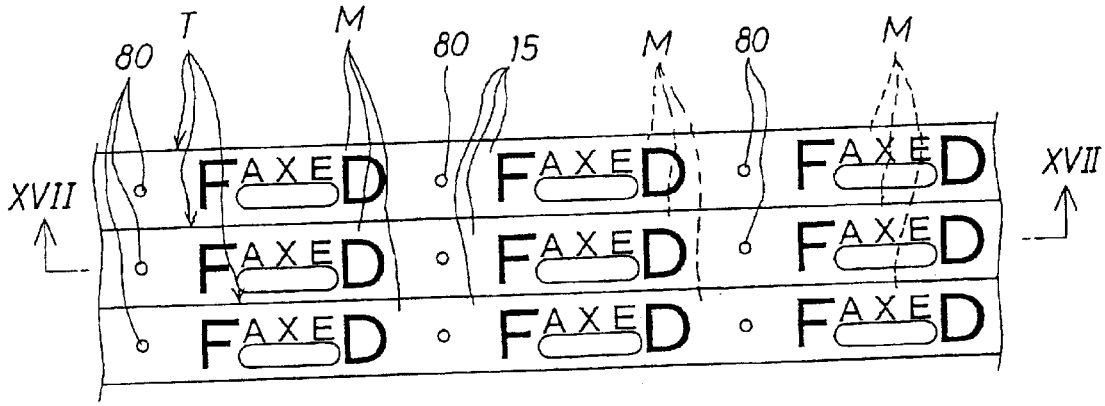
FIG. 17A is a plan of the mark transfer tape of the mark transfer tool, showing a partially cut-away view of the mark transfer tape in the manufacturing process.
Figure 17B:
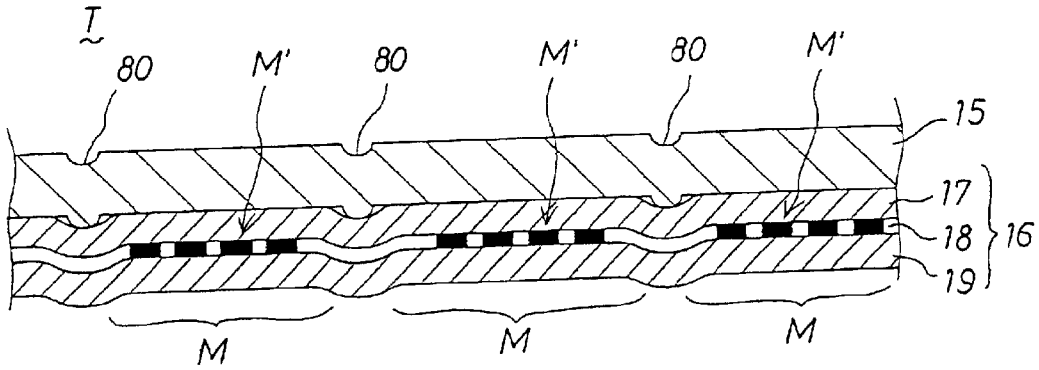
FIG. 17B is a sectional view along line XVII—XVII in FIG. 17A of the mark transfer tape.
Figure 17C:
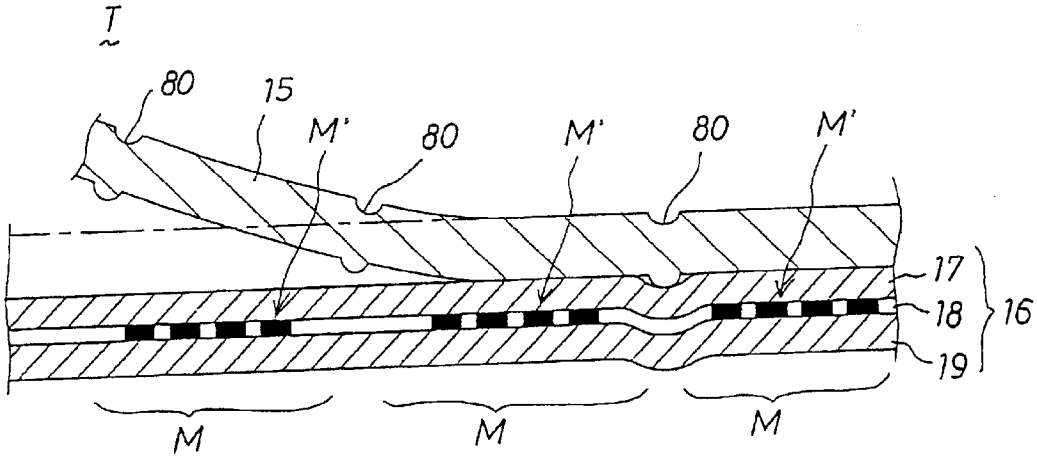
FIG. 17C is a sectional view showing a peeling state of base tape and transfer mark layer of the mark transfer tape.

This embodiment is shown in FIGS. 13A–13B, in which the bodily sensing engaging part 61 in embodiment 4 is replaced by a structure of the leading end pressing portion (leading edge) 25 of the transfer head H functioning as a bodily sensing engaging part to be engaged with the bodily sensing recesses 60, 60 of the mark transfer tape T.

That is, in the mark transfer tape T of the embodiment, in the mark transfer operation of the mark transfer tool 1, when the notches 60, 60 are engaged with the leading end pressing portion 25 of the transfer head H, a hooking phenomenon occurs in the running operation of the mark transfer tape T, so that transfer complete position of one transfer mark M is known by bodily sensation.

The other configuration and operation are same as in embodiment 4.

Embodiment 6

This embodiment is shown in FIGS. 14A–14C and FIGS. 15A–15C, in which the specific structure of the bodily sensing recess (bodily sensing means) in embodiment 4 is slightly modified.

That is, same as in embodiment 4, a bodily sensing recess 70 of the embodiment is formed between mutually adjacent transfer marks M, M of the mark transfer tape T, but the notch 70 in this embodiment is tiny holes provided in the center in the width direction of the mark transfer tape T, and the tiny holes 70 are circular in order to prevent breakage of the base tape 15 due to stress concentration.

Corresponding to this, a bodily sensing engaging part 71 provided in the transfer head H is a positioning bump so as to be engaged with the tiny hole 70 in convex-concave relation.

This positioning bump 71 is, specifically, a swollen bump integrally formed simultaneously with forming of the head main body 30, and its contour is circular corresponding to the notch 70. The location of the positioning bump 71 is slightly behind the leading end pressing portion 25, and is at the central position in the width direction of the mark transfer tape T.

The other configuration and operation are same as in embodiment 4.

Embodiment 7

This embodiment is shown in FIGS. 16A–16C and FIGS. 17A–17C, in which the specific structure of the bodily sensing recess (bodily sensing means) in embodiment 6 is slightly modified.

That is, same as in embodiment 5, a bodily sensing recess 80 of the embodiment is a concave form provided in the center of the width direction of the mark transfer tape T, but the recess 80 in this embodiment is a dent provided in the center of the width direction at the back side of the mark transfer tape T.

This dent 80 is specifically curved from back side to surface side in part of the base tape 15, and its contour is circular.

Corresponding to this, a bodily sensing engaging part 81 provided in the transfer head H is a positioning bump so as to be engaged with the dent 80 in convex-concave relation.

This positioning bump 81 is, specifically, a swollen bump same as the positioning bump 71 in embodiment 5, and its contour is circular corresponding to the dent 80.

The other configuration and operation are same as in embodiment 6.

In this embodiment, too, same as in embodiment 5, the bodily sensing engaging part 81 may be replaced by a structure of the leading end pressing portion (leading edge) 25 of the transfer head H functioning as a bodily sensing engaging part to be engaged with the bodily sensing recesses 80 of the mark transfer tape T.

Embodiment 8

This embodiment is shown in FIGS. 18A–18C and FIGS. 19A–19C, in which the specific structure of the mark transfer tape T in embodiment 1 is slightly modified.

Figure 18A:
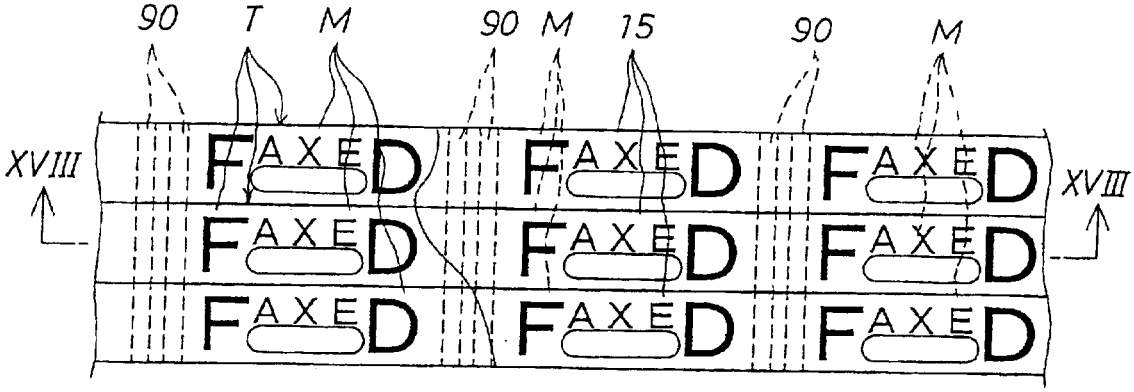
FIG. 18A is a plan of mark transfer tape of a mark transfer tool according to embodiment 8 of the invention, showing a partially cut-away view of the mark transfer tape in the manufacturing process.
Figure 18B:
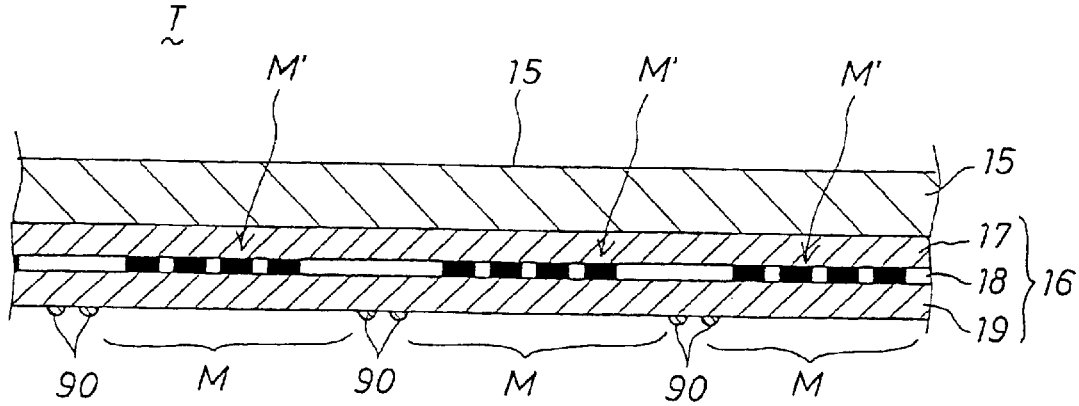
FIG. 18B is a sectional view along line XVIII—XVIII in FIG. 18A of the mark transfer tape.
Figure 18C:
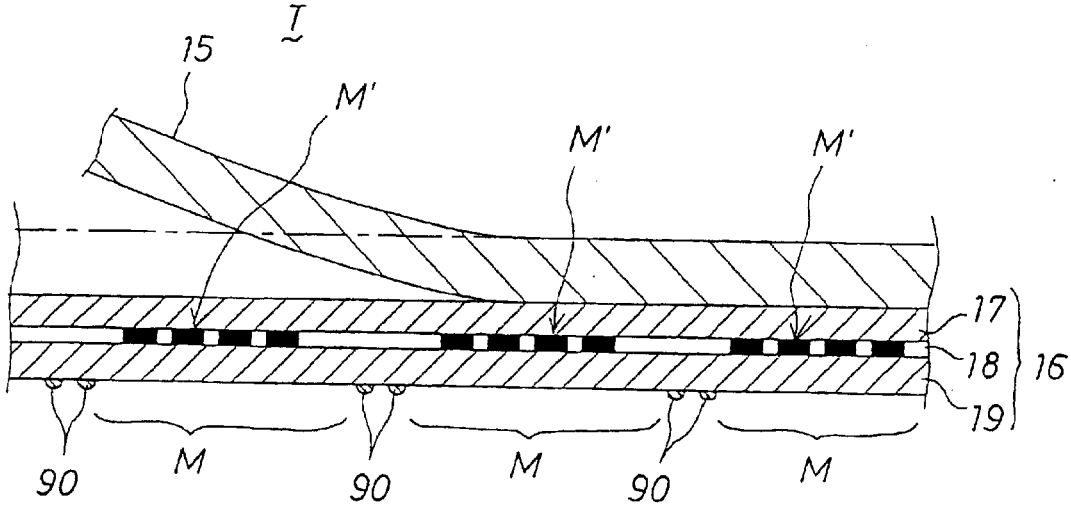
FIG. 18C is a sectional view showing a peeling state of base tape and transfer mark layer of the mark transfer tape.

That is, in the mark transfer tape T of this embodiment, division bodily sensing means 90 is a plurality of bodily sensing bumps formed between mutually adjacent transfer marks M, M. These bodily sensing bumps 90 are specifically two swollen forms provided on the surface (the lower side in FIG. 18B and FIG. 18C) of the transfer mark layer 16 as shown in FIGS. 18A–18C.

Figure 19A:
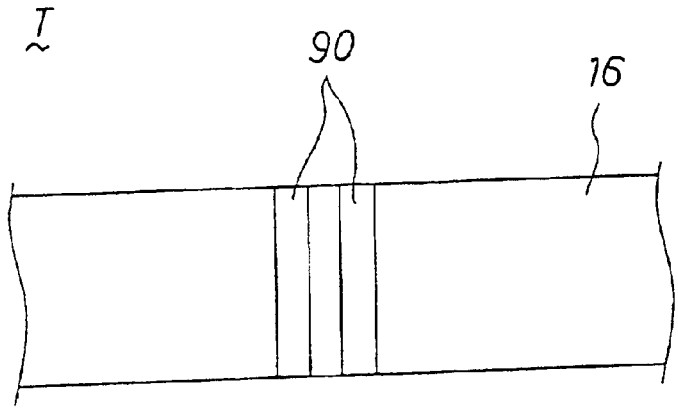
FIG. 19A is a plan showing a configuration of bodily sensing bump of the mark transfer tape.

These two bodily sensing bumps 90, 90 extend linearly parallel to the width direction of the mark transfer tape T between the transfer marks M, M of the transfer mark layer 16 as shown in FIG. 19A, a bodily sensing engaging part of the transfer head H is engaged with the these bodily sensing bumps 90, 90 in convex-concave relation.

In the shown example, same as in embodiment 1, the leading edge of the transfer head H, that is, the leading end pressing portion 25 functions also as this bodily sensing engaging part (not shown).

In mark transfer operation of the mark transfer tool 1, when the leading end pressing portion 25 of the transfer head H is engaged between the two bodily sensing bumps 90, 90, a hooking phenomenon occurs in the traveling motion of the mark transfer tape T, and transfer complete position of one transfer mark M is known by bodily sensation.

The other configuration and operation are same as in embodiment 1.

Figure 19B:
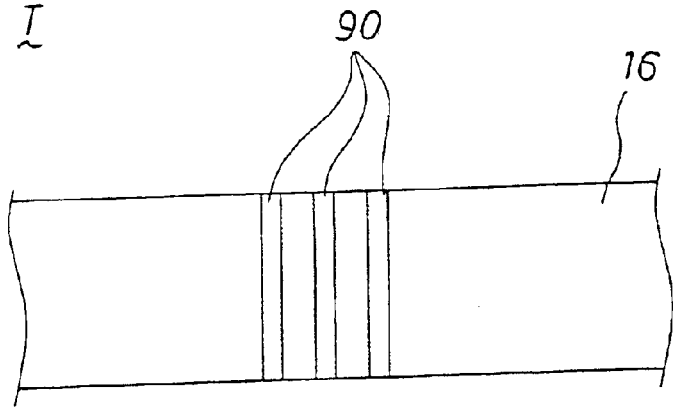
FIG. 19B is also a plan showing a configuration of bodily sensing bump of the mark transfer tape.
Figure 19C:
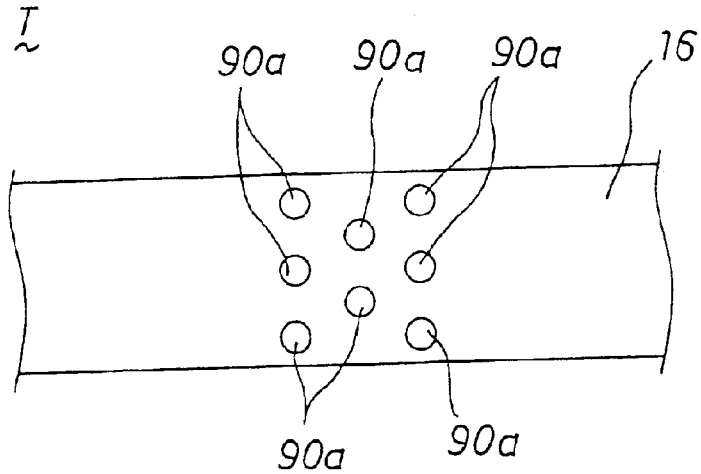
FIG. 19C a plan showing a configuration of bodily sensing bump of the mark transfer tape.

The specific shape and array structure of the bodily sensing bumps 90 are not limited to the examples in FIGS. 18A–18C and FIG. 19A, but other configurations having similar function, as shown in FIG. 19B and FIG. 19C may be also employed.

That is, in the configuration shown in FIG. 19B, three bodily sensing bumps 90, 90, 90 are provided linearly parallel to the width direction of the mark transfer tape T, and in the configuration shown in FIG. 19C, a plurality of swollen bodily sensing bumps 90*a* having a circular contour are arranged parallel in three rows.

Embodiment 9

Figure 20A:
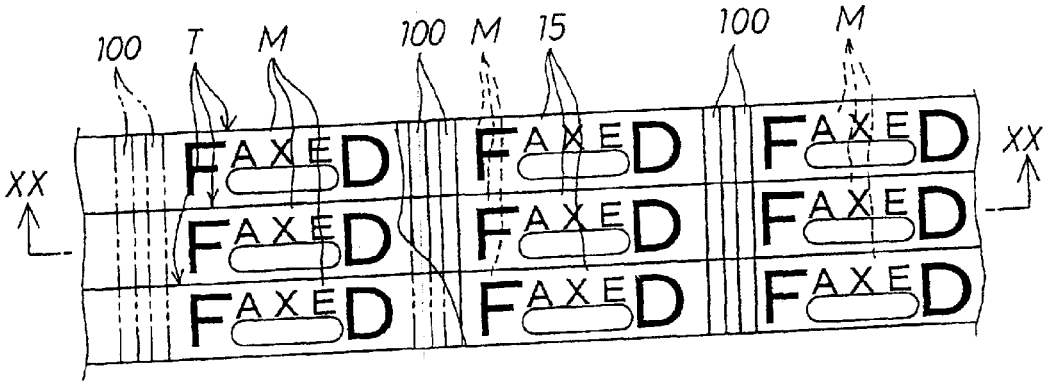
FIG. 20A is a plan of mark transfer tape of a mark transfer tool according to embodiment 9 of the invention, showing a partially cut-away view of the mark transfer tape in the manufacturing process.
Figure 20B:
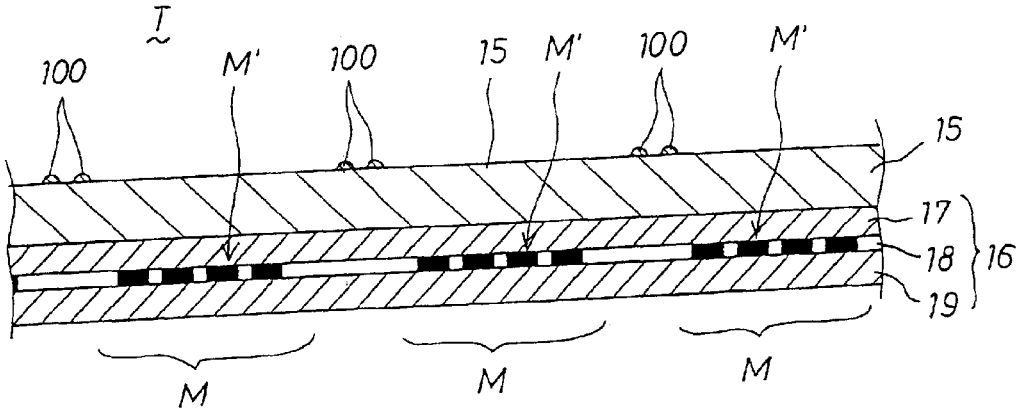
FIG. 20B is a sectional view along line XX—XX in FIG. 20A of the mark transfer tape.
Figure 20C:
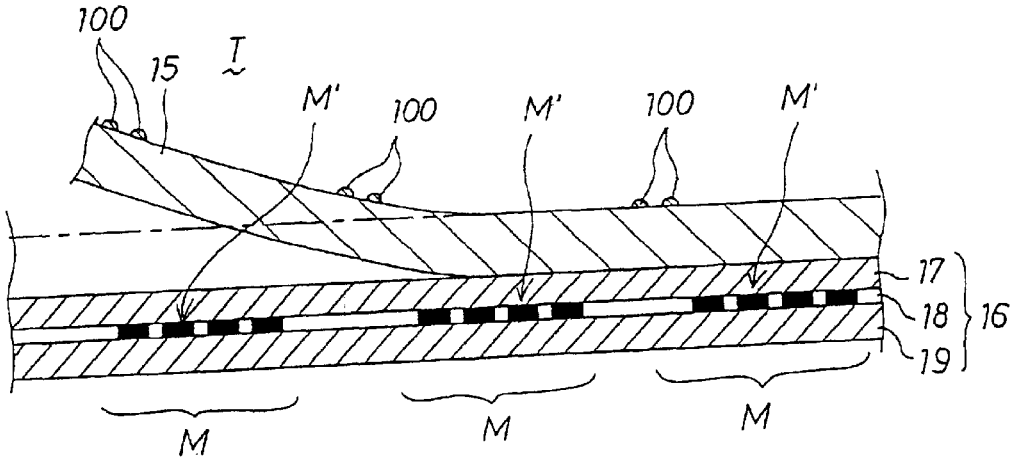
FIG. 20C is a sectional view showing a peeling state of base tape and transfer mark layer of the mark transfer tape.

This embodiment is shown in FIGS. 20A–20C, in which the specific structure of the mark transfer tape T in embodiment 8 is slightly modified.

That is, same as in embodiment 8, division bodily sensing means 100 in this embodiment is a plurality of bodily sensing bumps formed between mutually adjacent transfer marks M, N, but the bodily sensing bumps 100 in this embodiment are specifically two swollen forms provided on the back side (the upper side in FIG. 20B and FIG. 20C) of the transfer mark layer 16 as shown in FIGS. 20A–20C.

These two bodily sensing bumps 100, 100 extend linearly parallel to the width direction of the back side of the base tape 15 between the transfer marks M, M of the transfer mark layer 16 as shown in FIG. 20A, a bodily sensing engaging part of the transfer head H is engaged between the these bodily sensing bumps 100, 100 directly in convex-concave relation.

In the shown example, same as in embodiment 5, the leading edge of the transfer head H, that is, the leading end pressing portion 25 functions also as this bodily sensing engaging part (not shown).

The other configuration and operation are same as in embodiment 8.

Embodiment 10

Figure 21:
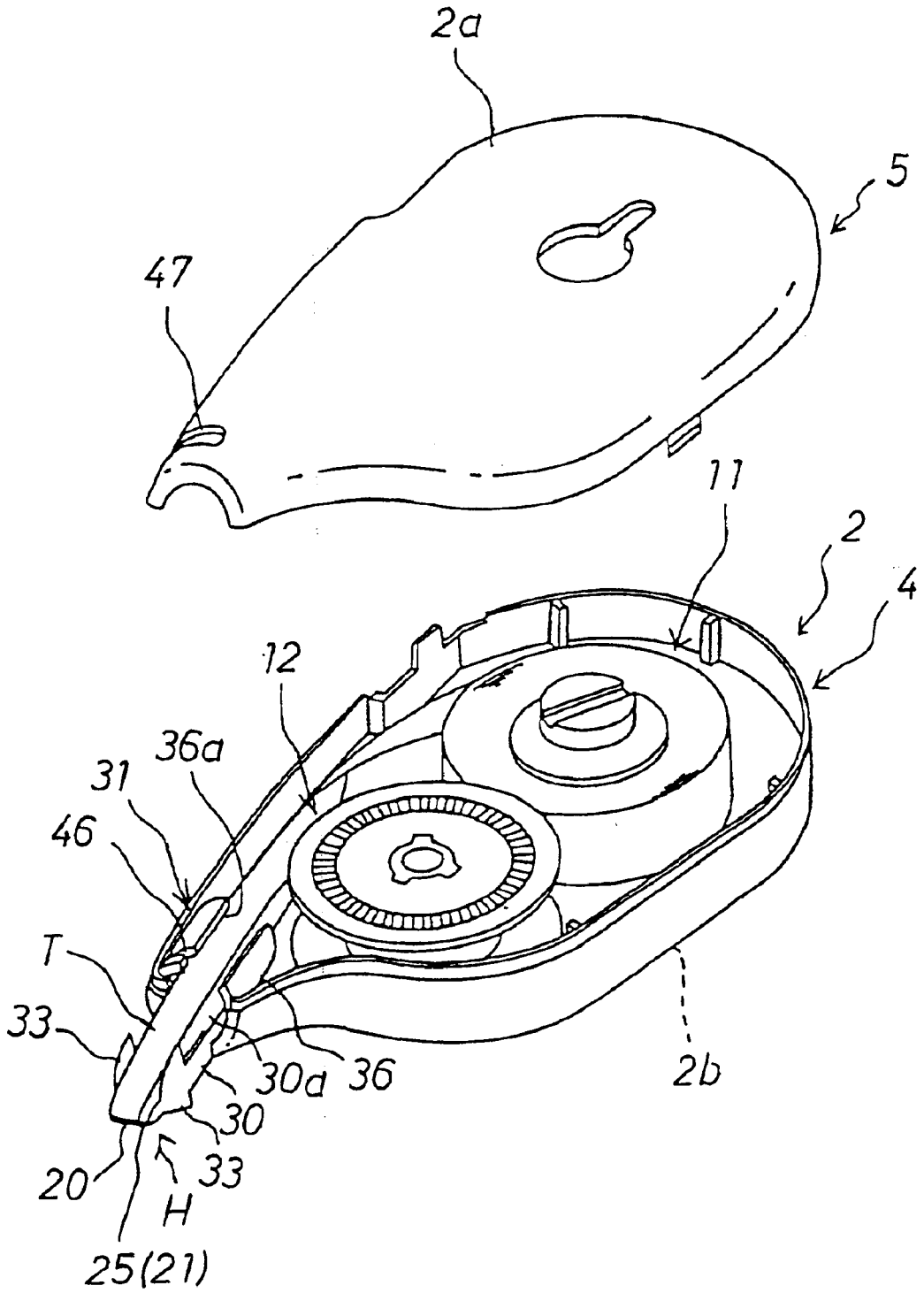
FIG. 21 is a perspective exploded view of a mark transfer tool according to embodiment 10 of the invention.

This embodiment is shown in FIG. 21, in which the basic structure of the mark transfer tool 1 is modified.

That is, in the mark transfer tool 1 of the foregoing embodiments, the mark transfer tape T as a consumable part is an exchangeable cartridge type, that is, refill type, whereas this embodiment presents a one-time disposable type, that is, all component parts including the mark transfer tape T are consumable parts.

In the mark transfer tool 1 of the embodiment, in a hand-held case 2, a pay-out reel 11 on which a mark transfer tape T is wound, and a take-up reel 12 for collecting the mark transfer tape T after use are installed, and a transfer head H is disposed at the leading end of the case 2 so as to be rotatable about its head axial center. The specific structure of the transfer head H is same as in embodiment 1, except for its mounting position.

Although not shown specifically, in the case main body 4 of the case 2, aside from the pay-out reel 11 and take-up reel 12, a tape interlock unit for mutually interlocking these reels 11, 12, a clutch mechanism for synchronizing the pay-out speed and take-up speed of the mark transfer tape T by the pay-out reel 11 and take-up reel 12, and other principal and basic mechanical parts are also assembled in a unit.

The other configuration and operation are same as in embodiment 1.

Embodiment 11

Figure 22A:
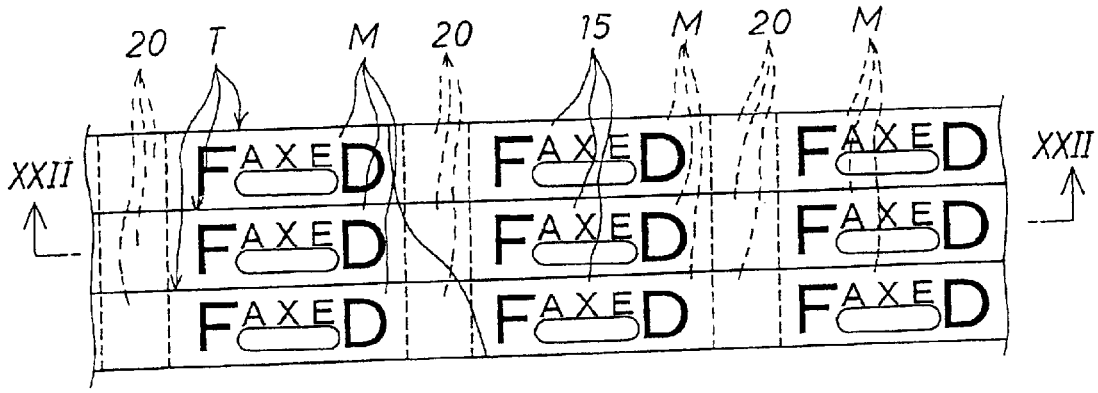
FIG. 22A is a plan of mark transfer tape of a mark transfer tool according to embodiment 11 of the invention, showing a partially cut-away view of the mark transfer tape in the manufacturing process.
Figure 22B:
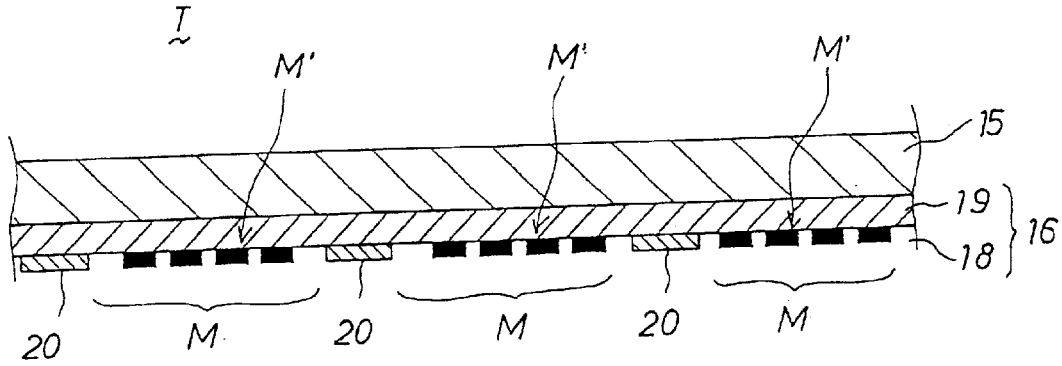
FIG. 22B is a sectional view along line XXII—XXII in FIG. 22A of the mark transfer tape.
Figure 22C:
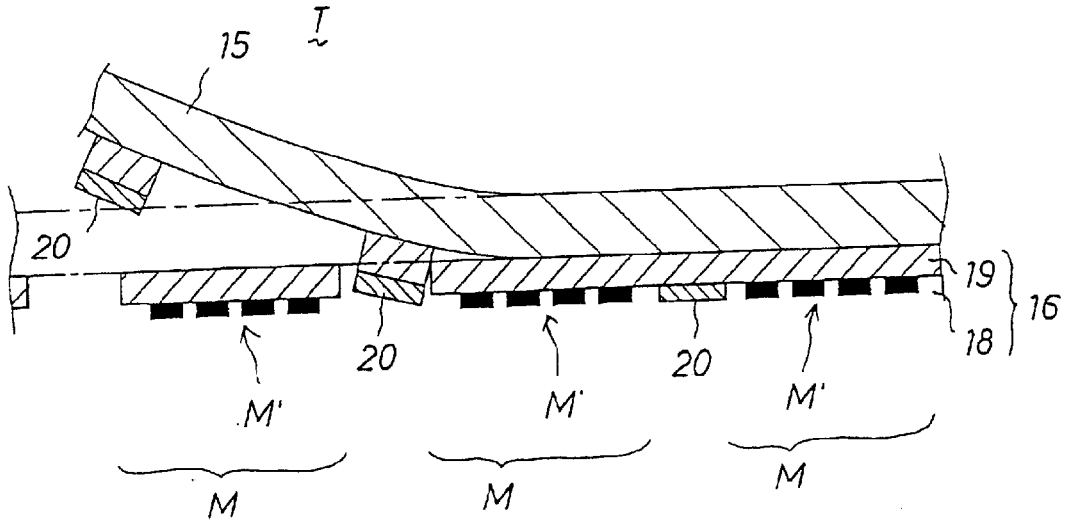
FIG. 22C is a sectional view showing a peeling state of base tape and transfer mark layer of the mark transfer tape.

This embodiment is shown in FIGS. 22A–22C, in which the structure of the mark transfer tape T is modified.

That is, in the mark transfer tape T of this embodiment, as shown in FIGS. 22A–22C, a transfer tape layer 16 to be adhered and held on the surface side (lower side in FIG. 22B and FIG. 22C) of a base tape 15 is an integral laminate structure consisting of a pressure-sensitive adhesive layer 19 and a mark array layer 18.

In the embodiment, the pressure-sensitive adhesive layer 19 also functions as the mark forming layer 17 in embodiment 1, and the mark array layer 18 is printed and formed on the surface of this mark forming layer 17.

Thus laminated transfer mark layer 16 is, as shown, adhered and held on the surface of the base tape 15 treated for parting (the lower side in FIG. 22B and FIG. 22C) peelably and separably through the pressure-sensitive adhesive layer 19.

In a specific forming method of the transfer mark layer 16, the pressure-sensitive adhesive layer 19 is applied and formed on the surface of the base tape 15, and the bodily sensing sliding part 20 is printed and formed on the surface thereof, then the mark array layer 18 is printed and formed further.

The other configuration and operation are same as in embodiment 1.

Embodiment 12

Figure 23A:
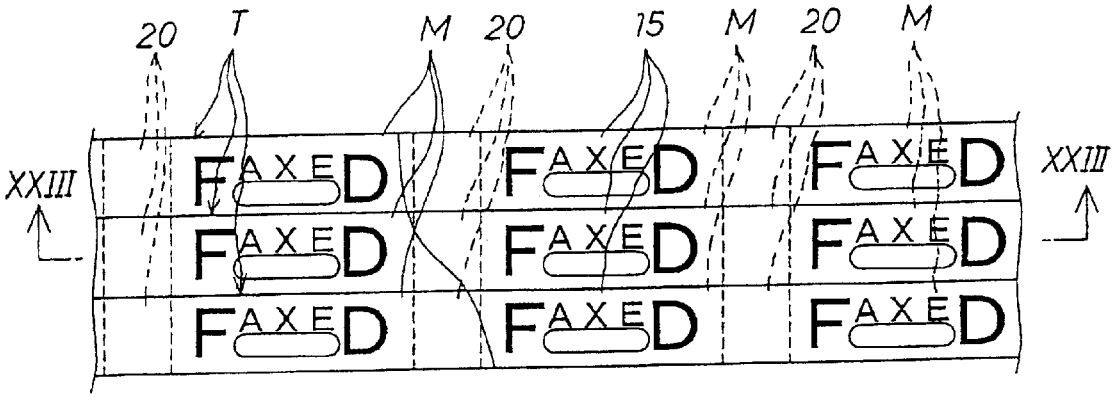
FIG. 23A is a plan of mark transfer tape of a mark transfer tool according to embodiment 12 of the invention, showing a partially cut-away view of the mark transfer tape in the manufacturing process.
Figure 23B:
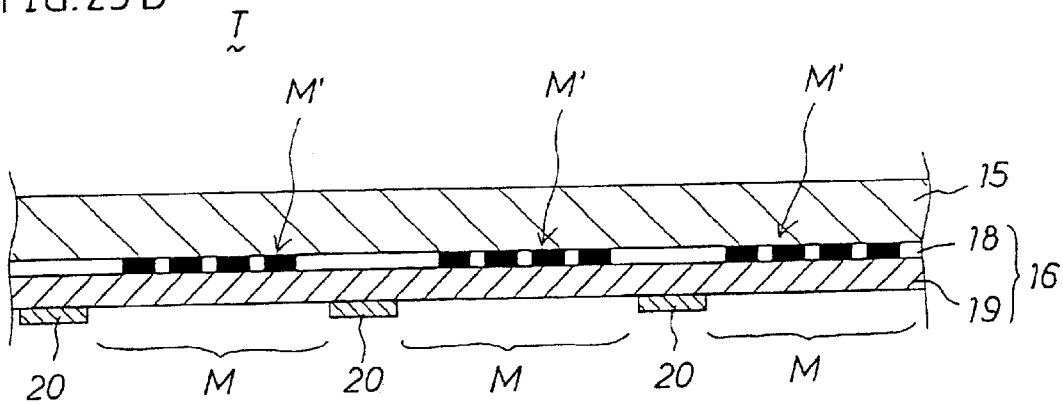
FIG. 23B is a sectional view along line XXIII—XXIII in FIG. 23A of the mark transfer tape.
Figure 23C:
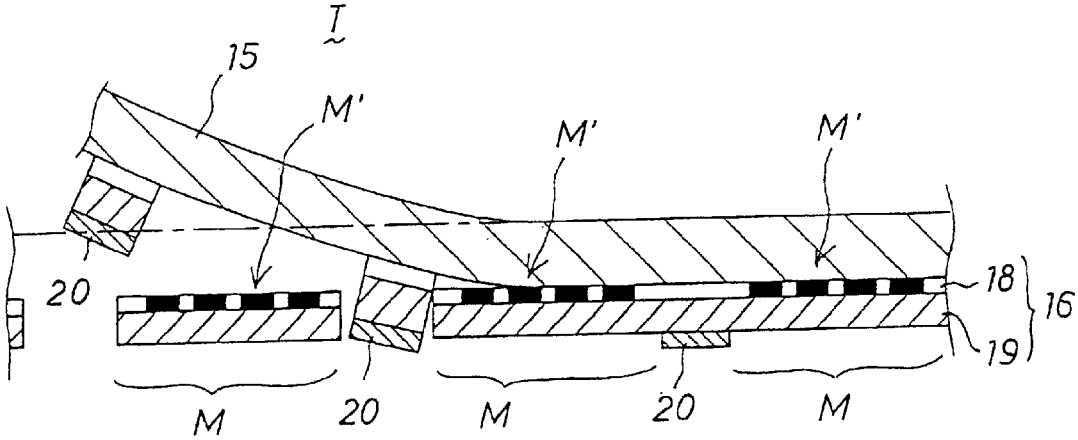
FIG. 23C is a sectional view showing a peeling state of base tape and transfer mark layer of the mark transfer tape.

This embodiment is shown in FIGS. 23A–23C, in which the structure of the mark transfer tape T is modified.

That is, in the mark transfer tape T of this embodiment, as shown in FIGS. 23A–23C, a transfer tape layer 16 to be adhered and held on the surface side (lower side in FIG. 23B, FIG. 23C) of a base tape 15 is an integral laminate structure consisting of a mark array layer 18 and a pressure-sensitive adhesive layer 19, and the mark forming layer 17 in the mark transfer tape T in embodiment 1 is omitted.

In other words, the mark array layer 18 is directly printed and formed on the parting treated surface of the base tape 15, and when transferring a mark, therefore, the mark array layer 18 is peeled from the surface of the base tape 15, and the surface layer is formed directly. The other configuration and operation are same as in embodiment 1.

Embodiment 13

Figure 24A:
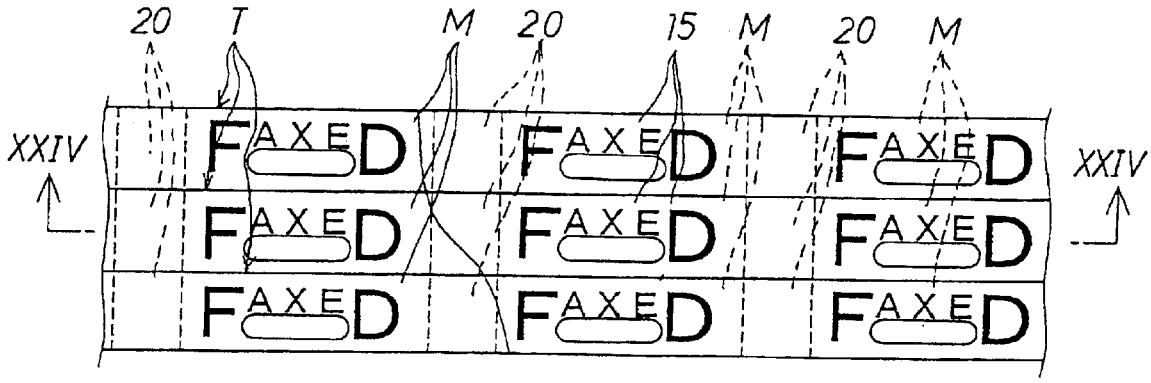
FIG. 24A is a plan of mark transfer tape of a mark transfer tool according to embodiment 13 of the invention, showing a partially cut-away view of the mark transfer tape in the manufacturing process.
Figure 24B:
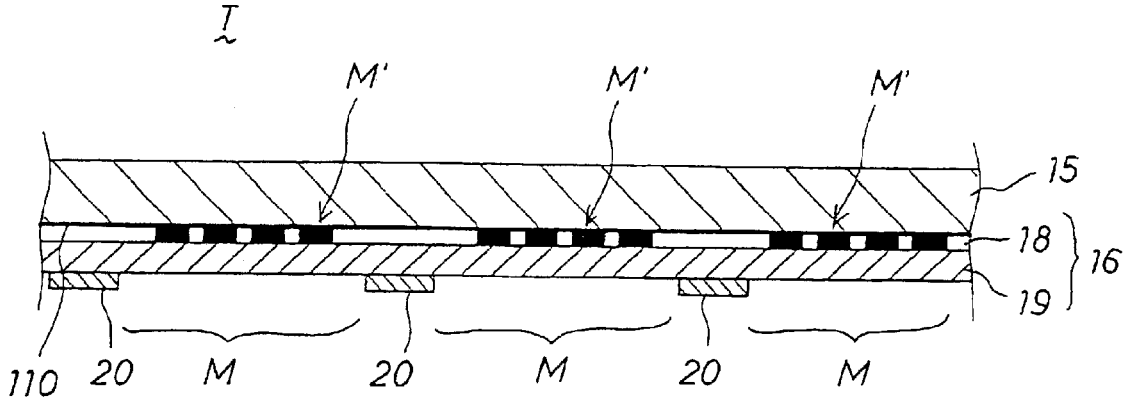
FIG. 24B is a sectional view along line XXIV—XXIV in FIG. 24A of the mark transfer tape.
Figure 24C:
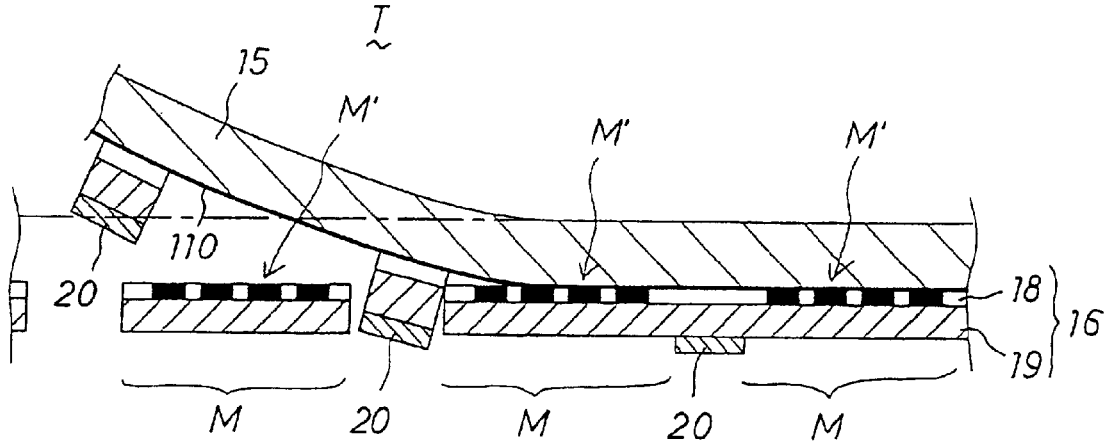
FIG. 24C is a sectional view showing a peeling state of base tape and transfer mark layer of the mark transfer tape.

This embodiment is shown in FIGS. 24A–24C, in which the structure of the mark transfer tape T in embodiment 12 is slightly modified.

That is, in the mark transfer tape T of this embodiment, as shown in FIGS. 24A–24C, the surface side (lower side in FIG. 22B and FIG. 22C) of a base tape 15 is treated to be adhesive 110, and a mark array layer 18 is directly printed and formed on this surface. When transferring a mark, therefore, the mark array layer 18 is peeled from the surface of the base tape 15, and the surface layer is formed directly.

The other configuration and operation are same as in embodiment 12.

Embodiment 14

Figure 25A:
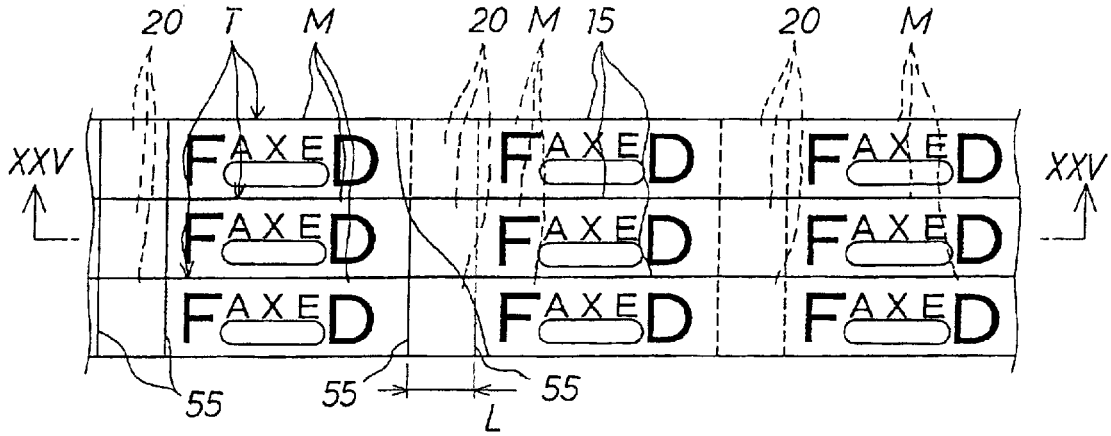
FIG. 25A is a plan of mark transfer tape of a mark transfer tool according to embodiment 14 of the invention, showing a partially cut-away view of the mark transfer tape in the manufacturing process.
Figure 25B:
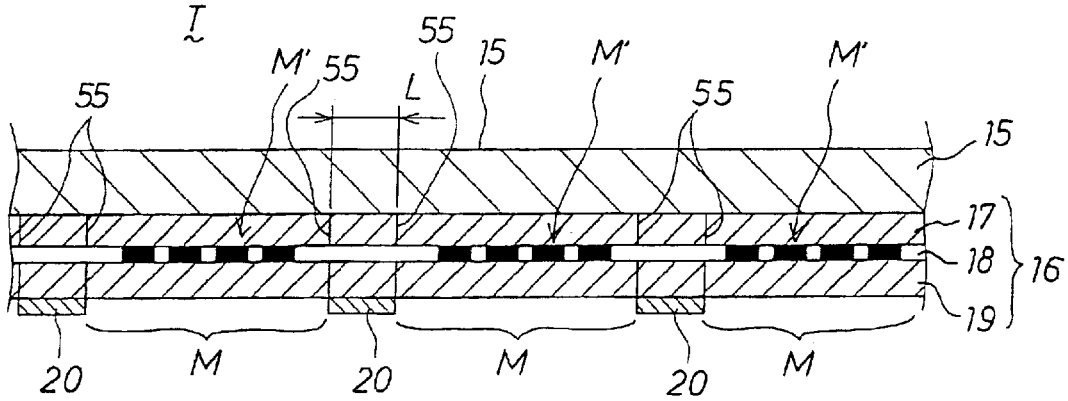
FIG. 25B is a sectional view along line XXV—XXV in FIG. 25A of the mark transfer tape.
Figure 25C:
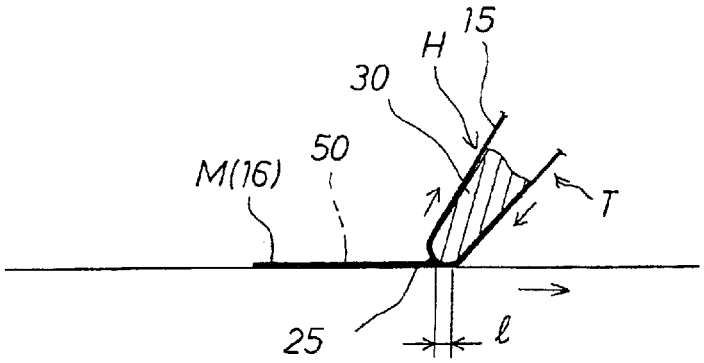
FIG. 25C is a sectional view showing the pressing width of leading end pressing portion of transfer head of mark transfer tool in relation to the mark transfer tape.

This embodiment is shown in FIGS. 25A–25C, in which the structure of the mark transfer tape T in embodiment 1 is slightly modified.

That is, in the mark transfer tape T of the embodiment, same as the mark transfer tape T in embodiment 1, the transfer mark layer 16 is formed continuously over the entire length of the base tape 15, but as shown in FIGS. 25A–25C, at least two cut-off sections 55, 55 are provided at specific interval between the transfer marks M, M of the transfer mark layer 16, and the transfer mark M can be cut off more easily and securely when transferring.

In the shown embodiment, the two cut-off sections 55, 55 are provided in the central position of the transfer marks M, M at a specific interval. These cut-off sections 55, 55 are extended and formed vertically and straightly in the longitudinal direction of the transfer tape T in the overall width of the transfer mark layer 16. The interval L of the cut-off sections 55, 55 is set larger than the pressing width I (see FIG. 25C) of the leading end pressing portion 25 of the transfer head H (L>I).

In such configuration, same as in the transfer operation explained in embodiment 1, in the previous mark transfer operation completion state (when the visual recognition line 20 coincides visually with the visual recognition positioning part 21), the transfer head H is tightly pressed to the transfer start end on the correction area 50, and the case 2 is directly moved along the sheet of paper, and is stopped when the next visual recognition line 20 coincides with the visual recognition positioning part 21, and the transfer head H is lifted and removed from the correction area 50. In this case, at the stopping position of the mark transfer tool 1, the leading end pressing portion 25 of the transfer head H is between the two cut-off sections 55, 55.

By this operation, only one transfer mark M of the mark transfer tape T is peeled securely from the base tape 15 at the position of cut-off section 55, and transferred onto the correction area 50, and the cut-off line is straight.

The other configuration and operation are same as in embodiment 1.

Embodiment 15

Figure 26A:
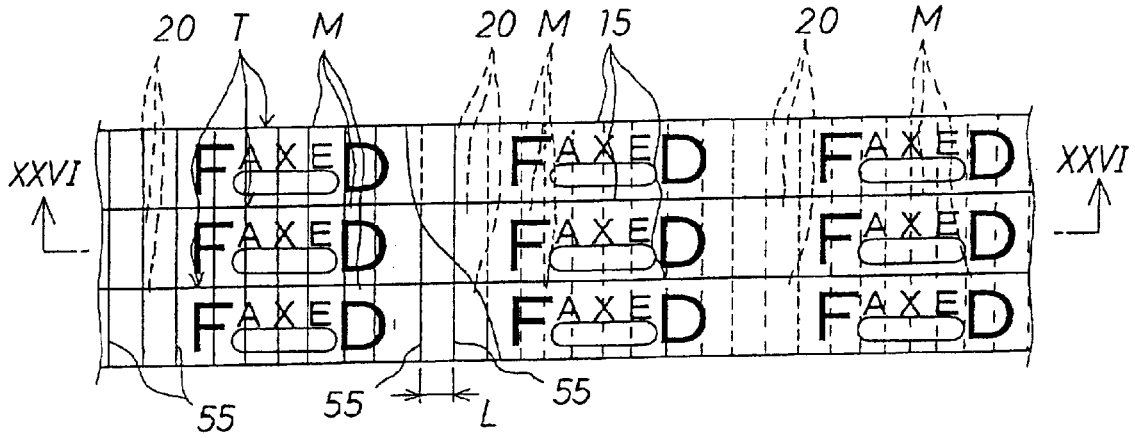
FIG. 26A is a plan of mark transfer tape of a mark transfer tool according to embodiment 15 of the invention, showing a partially cut-away view of the mark transfer tape in the manufacturing process.
Figure 26B:
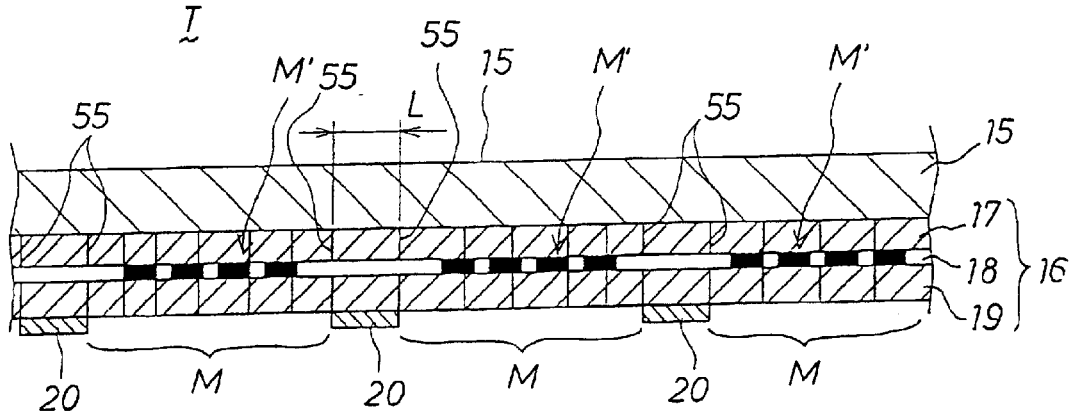
FIG. 26B is a sectional view along line XXVI—XXVI in FIG. 26A of the mark transfer tape.
Figure 26C:
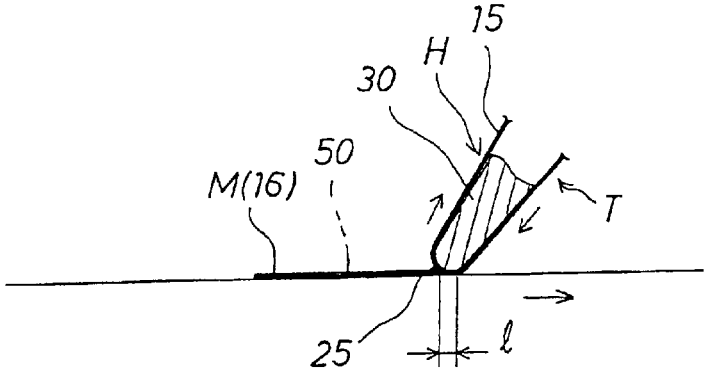
FIG. 26C is a sectional view showing the pressing width of leading end pressing portion of transfer head of mark transfer tool in relation to the mark transfer tape.

This embodiment is shown in FIGS. 26A–26C, in which the structure of the mark transfer tape T in embodiment 14 is modified.

That is, in the mark transfer tape T of embodiment 14, two cut-off sections 55, 55 are provided at specific interval only between the transfer marks M, M of the transfer mark layer 16, but in the mark transfer tape T of the embodiment, multiple cut-off sections 55, 55, . . . are provided at specific interval in the transfer mark layer 16 over the entire length of the transfer mark layer 16.

In such configuration, in the manufacturing process of the mark transfer tape T, the cut-off sections 55, 55, . . . can be formed easily and securely as compared with the case of embodiment 14.

In transfer operation, it is the same as in embodiment 14 that only one transfer mark M on the mark transfer tape T is transferred on the correction area 50, with the cut-off line being straight, but in this case the stopping position condition of the mark transfer tool 1 is less strict than in embodiment 14, and by lifting the mark transfer tool 1 when the visual recognition line 20 nearly coincides with the visual recognition positioning part 21 visually, the transfer mark M is securely peeled off from the base tape 15 at the position of cut-off section 55, and is transferred on the correction area 50, so that the transfer mark M is cut off more easily and securely when transferring.

The other configuration and operation are same as in embodiment 14.

The foregoing embodiments are only preferred embodiments for carrying out the invention, and the invention is not limited by them, but can be changed and modified in various forms within its scope.

The specific structure of the mark transfer tool 1 may be also realized in other designs. For example, the transfer head H in the shown embodiments is of so-called rotary head structure in which the head main body 30 is rotatably held about its axial center, and it is allowed to use in various tape pressing and transferring positions as shown in FIGS. 7A to 7C, but it may be also realized in a fixed head structure so as to be usable only in a specific one of these tape pressing and transferring positions.

As described herein, the mark transfer tool of the invention is a mark transfer tool for transferring a transfer mark on a mark transfer tape on a sheet of paper or the like, comprising a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the correction area, being disposed at the leading end of the case, in which the mark transfer tape has pressure-sensitive adhesive transfer marks disposed and held continuously at specific intervals peelably on the surface of a base tape, the transfer mark is composed of various marks and overwriting blank spaces, division bodily sensing means showing division positions of transfer marks is disposed between transfer marks, and bodily sensing engaging parts to be engaged with the division bodily sensing means of the mark transfer tape are disposed on the tape traveling area of the transfer head, and therefore it presents a novel mark transfer technology completely different from the conventional mark using technology, about various marks composed of characters, codes, patterns or their combination, by making use of stamp, impression, mark seal or adhesion technology, so as to be effectively applicable to diversified preferences of general users.

That is, when transferring a transfer mark on the mark transfer tape on a desired correction area of a sheet of paper or the like by using the mark transfer tool of the invention, the case of the mark transfer tool is gripped by fingers, and the leading end pressing portion of the transfer head is tightly pressed to the correction area, and is moved along the sheet of paper, so that the transfer mark is transferred.

More specifically, with the division bodily sensing means provided in the mark transfer tape being engaged with the bodily sensing engaging part of the transfer head, the transfer head is tightly pressed to the transfer start end on the correction area, and the case is directly moved along the sheet of paper, and is stopped when the next division bodily sensing means is engaged with the bodily sensing engaging part to cause a sliding phenomenon at this engaging position or a hooking phenomenon in the traveling action of the mark transfer tape.

By this operation, the transfer mark on the mark transfer tape in the leading end pressing portion of the transfer head is peeled from the base tape, and is precisely transferred on the correction area, and the used mark transfer tape after peeling the transfer mark, that is, the base tape is taken up and collected on the take-up reel.

Further, since the transfer mark is composed of the mark and overwriting blank space, after transfer of transfer mark, desired characters may be written over by a writing tool on the overwriting blank space.

Since such overwriting blank area is provided in the transfer mark, it is possible to write in a position of a material not to be written directly by writing tool or a material not to be erased cleanly if once written.

Exemplary embodiments presented in the detailed description of the invention above are intended to disclose the technical features of the invention, and it is to be understood that the invention is not limited to those illustrated embodiments alone but is interpreted in a wider sense of meaning, and that various changes and modifications may be effected without departing from the scope or true spirit of the invention.

What is claimed is:

1. A mark transfer tool for transferring a transfer mark on a mark transfer tape on a sheet of paper or the like, comprising:

a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the correction area, being disposed at the leading end of the case, wherein said mark transfer tape has pressure-sensitive adhesive transfer marks disposed and held continuously at specific intervals peelably on the surface of a base tape, said transfer mark being composed of a mark and an overwriting blank space, and division bodily sensing means showing division positions of transfer marks is disposed between transfer marks, and a bodily sensing engaging part to be engaged with the division bodily sensing means of the mark transfer tape is disposed in the tape traveling part of the transfer head.

2. The mark transfer tool of claim 1, wherein at least the surface forming portion of the overwriting blank space of the transfer mark is made of a material to be written over by a writing tool.

3. The mark transfer tool of claim 1, wherein a transfer mark layer composed of multiple transfer marks is peelably adhered and held at the surface side of the base tape of which back side is treated to be parted.

4. The mark transfer tool of claim 1, wherein at least two cut-off sections are provided at specific interval between transfer marks of the transfer mark layer, and these cut-off sections are extended and formed straightly over the entire width of the transfer mark layer.

5. The mark transfer tool of claim 1, wherein multiple cut-oft sections are provided at specific interval in the entire length of the transfer mark layer, and these cut-off sections are extended and formed straightly over the entire width of the transfer mark layer.

6. The mark transfer tool of claim 4 or 5, wherein the disposing interval of the cut-oft sections is set larger than the pressing width of the leading end pressing portion of the transfer head for pressing and transferring the transfer head.

7. The mark transfer tool of claim 1, wherein said division bodily sensing means is a bodily sensing sliding part formed between mutually adjacent transfer marks in the mark transfer tape, and said bodily sensing engaging part is a leading edge of the transfer head, and in mark transfer operation, when the bodily sensing sliding part is engaged with the leading edge of the transfer head, a sliding phenomenon occurs in the engaging position, so that transfer complete position of one transfer mark is known by bodily sensation.

8. The mark transfer tool of claim 7, wherein said bodily sensing sliding part is disposed at the surface side of the mark transfer tape, and in mark transfer operation, when the bodily sensing sliding part is engaged with the leading edge of the transfer head, sliding occurs between the bodily sensing sliding part and the correction area, so that transfer complete position of one transfer mark is known by bodily sensation.

9. The mark transfer tool of claim 1, wherein said division bodily sensing means is a bodily sensing recess formed between mutually adjacent transfer marks in the mark transfer tape, and said bodily sensing engaging part is a positioning bump provided in the transfer head, and in mark transfer operation, when the bodily sensing recess is engaged with the positioning bump of the transfer head, a hooking phenomenon occurs in the traveling motion of the mark transfer tape, so that transfer complete position of one transfer mark is known by bodily sensation.

10. The mark transfer tool of claim 9, wherein said bodily sensing recess is an arc-shaped notch provided at least in one end part in the width direction of the mark transfer tape.

11. The mark transfer tool of claim 9, wherein said bodily sensing recess is a circular tiny hole provided in the center in the width direction of the mark transfer tape.

12. The mark transfer tool of claim 9, wherein said bodily sensing recess is an arc-shaped notch provided at least in one end part in the width direction of the mark transfer tape, and the positioning bump has an arc contour shape to this notch.

13. The mark transfer tool of claim 9, wherein said bodily sensing recess is a circular tiny hole provided in the center in the width direction of the mark transfer tape, and the positioning bump has a circular contour shape corresponding to this tiny hole.

14. The mark transfer tool of claim 9, wherein said bodily sensing recess is a circular dent provided in the center in the width direction of the mark transfer tape, and the positioning bump has a circular contour shape corresponding to this dent.

15. The mark transfer tool of claim 1, wherein said division bodily sensing means is a plurality of bodily sensing bumps formed between mutually adjacent transfer marks in the mark transfer tape, and said bodily sensing engaging part is a positioning bump provided in the transfer head, and in mark transfer operation, when the positioning bump is engaged between the plurality of bodily sensing bumps, a hooking phenomenon occurs in the traveling motion of the mark transfer tape, so that transfer complete position of one transfer mark is known by bodily sensation.

16. The mark transfer tool of claim 15, wherein said plurality of bodily sensing bumps are disposed at the surface side of the mark transfer tape, and said bodily sensing engaging part is a leading edge of the transfer head, and in mark transfer operation, when the leading edge of the transfer head is engaged between the plurality of bodily sensing bumps, a hooking phenomenon occurs in the traveling motion of the mark transfer tape, so that transfer complete position of one transfer mark is known by bodily sensation.

17. The mark transfer tool of claim 15, wherein said plurality of bodily sensing bumps are disposed at the back side of the mark transfer tape, and said bodily sensing engaging part is a leading edge of the transfer head, and in mark transfer operation, when the leading edge of the transfer head is engaged between the plurality of bodily sensing bumps, a hooking phenomenon occurs in the traveling motion of the mark transfer tape, so that transfer complete position of one transfer mark is known by bodily sensation.

18. The mark transfer tool of any one of claims 1–3, 4, 5, 7, 11 and 12–17, wherein a tape cartridge comprising at least the pay-out reel and take-up reel is of refill type being detachably disposed in the case and having a structure so that the mark transfer tape may be exchanged.

19. The mark transfer tool of any one of claims 1–3, 4, 5, 7, 11 and 12–17, wherein it is of onetime type having the pay-out reel and take-up reel disposed in the case, with the transfer head provided at the leading end of the case.

20. A mark transfer tape disposed and used in a mark transfer tool for transferring a transfer mark on a sheet of paper, wherein pressure-sensitive adhesive transfer marks are disposed and held continuously at specific intervals peelably on the surface of a base tape, said transfer mark being composed of a mark and an overwriting blank space, and division bodily sensing means showing division positions of transfer marks is disposed between transfer marks, and this division bodily sensing means is configured to indicate the division position of one transfer mark by bodily sensation when engaged with a bodily sensing engaging part provided on the transfer head of the mark transfer tool in the mark transfer operation of the mark transfer tool.

21. The mark transfer tool of claim 20, wherein at least the surface forming portion of the overwriting blank space of the transfer mark is made of a material to be written over by a writing tool.

22. The mark transfer tool of claim 20, wherein a transfer mark layer composed of multiple transfer marks is peelably adhered and held at the surface side of the base tape of which back side is treated to be parted.

23. The mark transfer tool of claim 20, wherein a transfer mark layer composed of multiple transfer marks is peelably and detachably adhered and held at the surface side of the base tape of which back side is treated to be parted.

24. The mark transfer tool of claim 23, wherein at least two cut-off sections are provided at specific interval between transfer marks of the transfer mark layer, and these cut-off sections are extended and formed straightly over the entire width of the transfer mark layer.

25. The mark transfer tool of claim 23, wherein multiple cut-off sections are provided at specific interval in the entire length of the transfer mark layer, and these cut-off sections are extended and formed straightly over the entire width of the transfer mark layer.

26. The mark transfer tool of claim 24 or 25, wherein the disposing interval of the cut-off sections is set larger than the pressing width of the leading end pressing portion of the transfer head for pressing and transferring the transfer head.

27. The mark transfer tool of claim 22 or 23, wherein the surface forming portion of the transfer mark is made of a material to be written over by a writing tool.

28. The mark transfer tape of claim 22 or 23, wherein said transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape treated for parting, peelably and detachably in pieces through the pressure-sensitive adhesive layer.

29. The mark transfer tape of claim 22 or 23, wherein said transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape treated for parting, peelably and detachably in pieces through the mark forming layer.

30. The mark transfer tape of claim 22 or 23, wherein said transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape treated for parting, peelably and detachably in pieces through the mark array layer.

31. The mark transfer tape of claim 22, wherein said division bodily sensing means is a bodily sensing sliding part formed of the surface of the base tape between mutually adjacent transfer mark layers, and in mark transfer operation, when the bodily sensing sliding part is engaged with the leading edge of the transfer head of the mark transfer tool, sliding occurs between the bodily sensing sliding part and the correction area, so that transfer complete position of one transfer mark is known by bodily sensation.

32. The mark transfer tape of any one of claims 23 to 25, wherein said division bodily sensing means is a bodily sensing sliding part formed corresponding to mutually adjacent transfer mark layers on the surface of the transfer mark layer, and in mark transfer operation, when the bodily sensing sliding part is engaged with the leading edge of the transfer head of the mark transfer tool, sliding occurs between the bodily sensing sliding part and the correction area, so that transfer complete position of one transfer mark is known by bodily sensation.

33. The mark transfer tape of any one of claims 22 to 25, wherein said division bodily sensing means is a bodily sensing recess formed between mutually adjacent transfer marks on the base tape, and in mark transfer operation, when the bodily sensing recess is engaged with the leading edge of the transfer head in convex-concave relation, hooking occurs in the mark transfer tape traveling motion, so that transfer complete position of one transfer mark is known by bodily sensation.

34. The mark transfer tape of any one of claims 22 to 25, wherein said division bodily sending means is a bodily sensing recess formed between mutually adjacent transfer marks on the back side of the base tape, and in mark transfer operation, when the bodily sensing recess is engaged with the bodily sensing engaging part provided in the transfer head of the mark transfer tool in convex-concave relation, hooking occurs in the tape traveling motion, so that transfer complete position of one transfer mark is known by bodily sensation.

35. The mark transfer tool of claim 33, wherein said bodily sensing recess is an arc-shaped notch provided at least in one end part in the width direction of the base tape, and is engaged with the bodily sensing engaging part of the transfer head having an arc contour shape corresponding to this notch in convex-concave relation.

36. The mark transfer tool of claim 34, wherein said bodily sensing recess is a circular tiny hole provided in the center in the width direction of the mark transfer tape, and is engaged with the bodily sensing engaging part of the transfer head having a circular contour shape corresponding to this tiny hole in convex-concave relation.

37. The mark transfer tool of claim 33, wherein said bodily sensing recess is a circular dent provided in the center in the width direction of the mark transfer tape, and is engaged with the bodily sensing engaging part of the transfer head having a circular contour shape corresponding to this dent in convex-concave relation.

38. The mark transfer tool of any one of claims 22 to 25, wherein said division bodily sensing means is a plurality of bodily sensing bumps formed between mutually adjacent transfer marks in the mark transfer tape, and in mark transfer operation, when the bodily sensing engaging part provided in the transfer head of the mark transfer tool is engaged between the plurality of bodily sensing bumps in convex-concave relation, a hooking phenomenon occurs in the tape traveling motion, so that transfer complete position of one transfer mark is known by bodily sensation.

39. The mark transfer tool of claim 38, wherein said plurality of bodily sensing bumps are disposed at the surface of the transfer mark layer, and in mark transfer operation, when the leading edge of the transfer head of the mark transfer tool is engaged with the plurality of bodily sensing bumps, a hooking phenomenon occurs in the tape traveling motion, so that transfer complete position of one transfer mark is known by bodily sensation.

40. The mark transfer tool of claim 38, wherein said plurality of bodily sensing bumps are disposed at the back side of the base tape, and in mark transfer operation, when the leading edge of the transfer head of the mark transfer tool is engaged with the plurality of bodily sensing bumps, a hooking phenomenon occurs in the tape traveling motion, so that transfer complete position of one transfer mark is known by bodily sensation.

* * * * *